US008789335B2

(12) United States Patent
Davis et al.

(10) Patent No.: US 8,789,335 B2
(45) Date of Patent: Jul. 29, 2014

(54) PORTABLE STRUCTURE

(75) Inventors: Adam Davis, Leola, PA (US); Tyler Kicera, Manheim, PA (US)

(73) Assignee: Tait Towers Manufacturing, LLC., Lititz, PA (US)

( * ) Notice: Subject to any disclaimer, the term of this patent is extended or adjusted under 35 U.S.C. 154(b) by 132 days.

(21) Appl. No.: 13/557,768

(22) Filed: Jul. 25, 2012

(65) Prior Publication Data

US 2014/0026514 A1 Jan. 30, 2014

(51) Int. Cl.
*E04H 12/18* (2006.01)

(52) U.S. Cl.
USPC ..... 52/645

(58) Field of Classification Search
CPC ..... E04C 3/005; E04C 3/00; E04C 3/04; E04C 3/08; E04B 1/19; E04B 1/343; E04B 1/3441; E04G 11/50
USPC ..... 52/633, 637, 645, 646, 656.1, 677, 678, 52/126.1, 143, 745.13
See application file for complete search history.

(56) References Cited

U.S. PATENT DOCUMENTS 2,354,906 A * 8/1944 Bailey et al. ..... 182/119
4,759,162 A * 7/1988 Wyse ..... 52/126.6
5,152,109 A * 10/1992 Boers ..... 52/143
5,230,197 A * 7/1993 Hart ..... 52/653.2
6,205,739 B1 * 3/2001 Newlin ..... 52/655.1
6,829,869 B1 * 12/2004 Savoie ..... 52/648.1
6,981,350 B1 * 1/2006 Redmon ..... 52/646
6,986,230 B2 * 1/2006 Schipani et al. ..... 52/694
7,516,590 B2 * 4/2009 Brinkmann ..... 52/651.01
7,703,401 B2 * 4/2010 Davis et al. ..... 108/156
7,922,416 B2 * 4/2011 Davis et al. ..... 403/322.1
7,992,353 B2 * 8/2011 Athan ..... 52/81.3
2002/0003194 A1 * 1/2002 Simmons ..... 248/49
2002/0059770 A1 * 5/2002 Fritsche et al. ..... 52/645
2003/0089049 A1 * 5/2003 Scissom et al. ..... 52/126.1
2003/0213204 A1 * 11/2003 Belanger ..... 52/645
2004/0088941 A1 * 5/2004 Boots ..... 52/655.1
2004/0134157 A1 * 7/2004 Hoberman ..... 52/633
2005/0005561 A1 * 1/2005 Hanson ..... 52/633
2005/0055954 A1 * 3/2005 Simmons ..... 52/633
2005/0066612 A1 * 3/2005 Simmons ..... 52/633
2006/0042179 A1 * 3/2006 Vanagan ..... 52/633
2006/0265992 A1 * 11/2006 Hiragaki ..... 52/633
2008/0115432 A1 * 5/2008 Groppe ..... 52/220.2
2008/0115816 A1 * 5/2008 Miller ..... 135/126
2008/0178551 A1 * 7/2008 Porter ..... 52/653.1
2008/0245021 A1 * 10/2008 Simmons ..... 52/633
2008/0251482 A1 * 10/2008 Davis et al. ..... 211/186
2008/0289284 A1 * 11/2008 Anwar et al. ..... 52/633
2010/0043629 A1 * 2/2010 Carberry et al. ..... 89/36.02
2010/0089697 A1 * 4/2010 Kreller ..... 182/113
2010/0192506 A1 * 8/2010 Allred et al. ..... 52/655.1
2011/0110714 A1 * 5/2011 Davis et al. ..... 403/321
2011/0185674 A1 * 8/2011 Daas et al. ..... 52/646
2011/0194889 A1 * 8/2011 Allred et al. ..... 403/170
2012/0102850 A1 * 5/2012 Kensinger et al. ..... 52/111

(Continued)

*Primary Examiner* — Mark Wendell
*Assistant Examiner* — Keith Minter

(57) ABSTRACT

A portable structure including a plurality of beams having a first engagement feature and a plurality of junction devices having a second engagement feature. The first engagement features and corresponding second engagement features are rigidly engageable, the rigidly engaged engagement features defining a multi-point connection therebetween. The engagement features are manually actuatable and self-contained.

20 Claims, 26 Drawing Sheets

(56) References Cited

U.S. PATENT DOCUMENTS

2012/0110946 A1* 5/2012 Daas et al. ..... 52/646
2012/0174518 A1* 7/2012 Litaize ..... 52/582.1
2012/0233954 A1* 9/2012 Schold ..... 52/650.1
2012/0240406 A1* 9/2012 Davis et al. ..... 29/897
2013/0055671 A1* 3/2013 Bruce ..... 52/646
2013/0145717 A1* 6/2013 Merrifield ..... 52/646
2013/0168522 A1* 7/2013 Daas et al. ..... 248/354.1
2013/0276382 A1* 10/2013 Workman et al. ..... 52/63

* cited by examiner

PORTABLE STRUCTURE

FIELD OF THE DISCLOSURE

The present disclosure relates to structures. More specifically, the present disclosure relates to rigid, portable structures and methods for assembly and disassembly of such structures.

BACKGROUND OF THE DISCLOSURE

In the entertainment industry, robust, rigid portable structures are often required, such as for traveling performances, and most notably in the music industry.

Lateral support structures often used in scaffolding typically include loose (removable) fasteners that require tools (e.g., wrenches) to ensure secure assembly, as well as to permit subsequent disassembly of the structures. Further, joints associated with these lateral supports are not rigidly engageable. That is, at least one end joint of the lateral support structure permits at least one of rotational movement and axial movement relative to a corresponding structural member to which the lateral support is secured.

Therefore, there is an unmet need to provide a portable structure and a method for assembling/disassembling portable structure having rigidly engageable features that are manually actuatable and self-contained. Such portable structure also significantly reduces assembly/disassembly time.

SUMMARY OF THE DISCLOSURE

According to an embodiment, a portable structure includes a plurality of beams having a first engagement feature and a plurality of junction devices having a second engagement feature. The first engagement features and corresponding second engagement features are rigidly engageable, the rigidly engaged engagement features defining a multi-point connection therebetween. The engagement features are manually actuatable and self-contained.

According to another embodiment, a method for providing a portable structure includes providing a plurality of beams having a first engagement feature. The method further includes providing a plurality of junction devices having a second engagement feature, the first engagement features and corresponding second engagement features being rigidly engageable and self-contained. The method further includes directing a first engagement feature of a beam of the plurality of beams and a corresponding second engagement feature of a junction device of the plurality of junction devices into engagement therebetween. The method further includes manually rigidly engaging the corresponding first and second engagement features to form multi-point connections therebetween.

An advantage of the present disclosure is a portable structure having engaged joints or connections that are rigid and self-contained.

Another advantage of the present disclosure is that engaged connections have a fail-safe feature.

Yet another advantage of the present disclosure is a portable structure having manually engaged joints or connections.

Still yet another advantage of the present disclosure is a multi-tiered portable structure that is assembled one tier at a time such that laborers remain on the ground.

Further aspects of the method and system are disclosed herein. The features as discussed above, as well as other features and advantages of the present disclosure will be appreciated and understood by those skilled in the art from the following detailed description and drawings.

BRIEF DESCRIPTION OF THE DRAWINGS

Wherever possible, the same reference numbers will be used throughout the drawings to represent the same parts.

DESCRIPTION OF THE DISCLOSURE

Figure 1A:
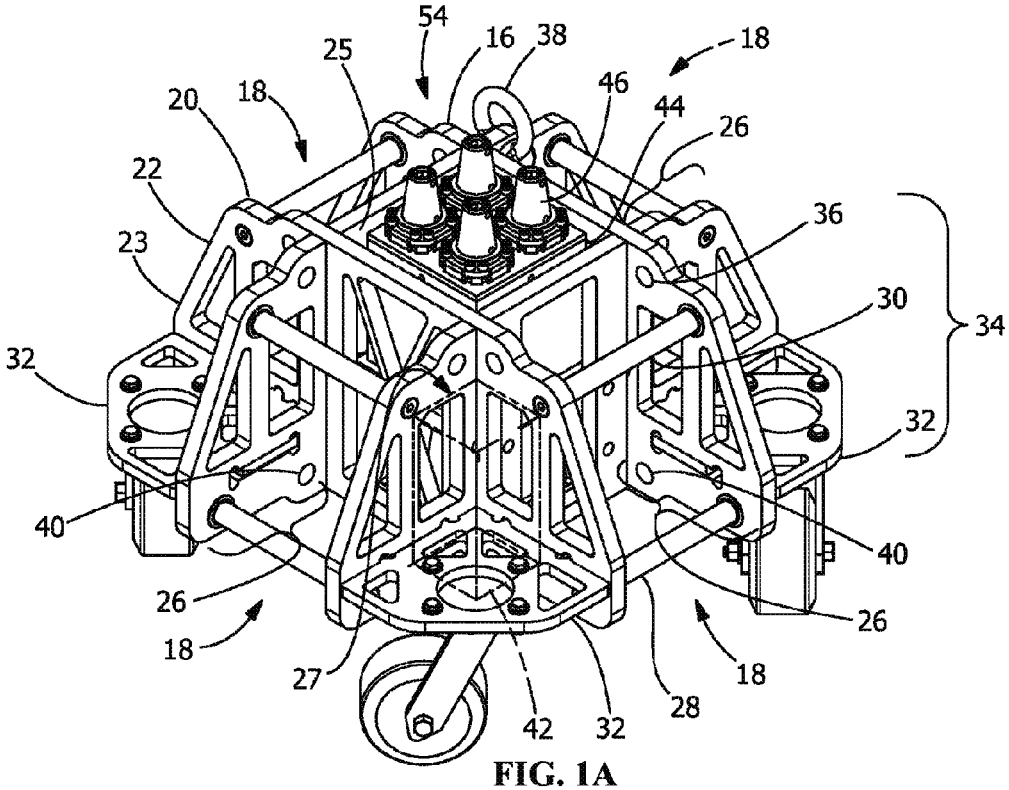
FIGS. 1A and 1B illustrate respective upper perspective and plan views of an exemplary embodiment of a junction device of a portable structure.
Figure 1B:
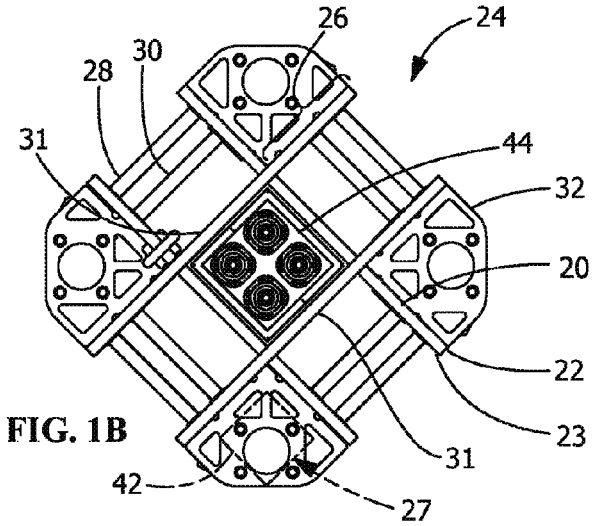
Figure 5:
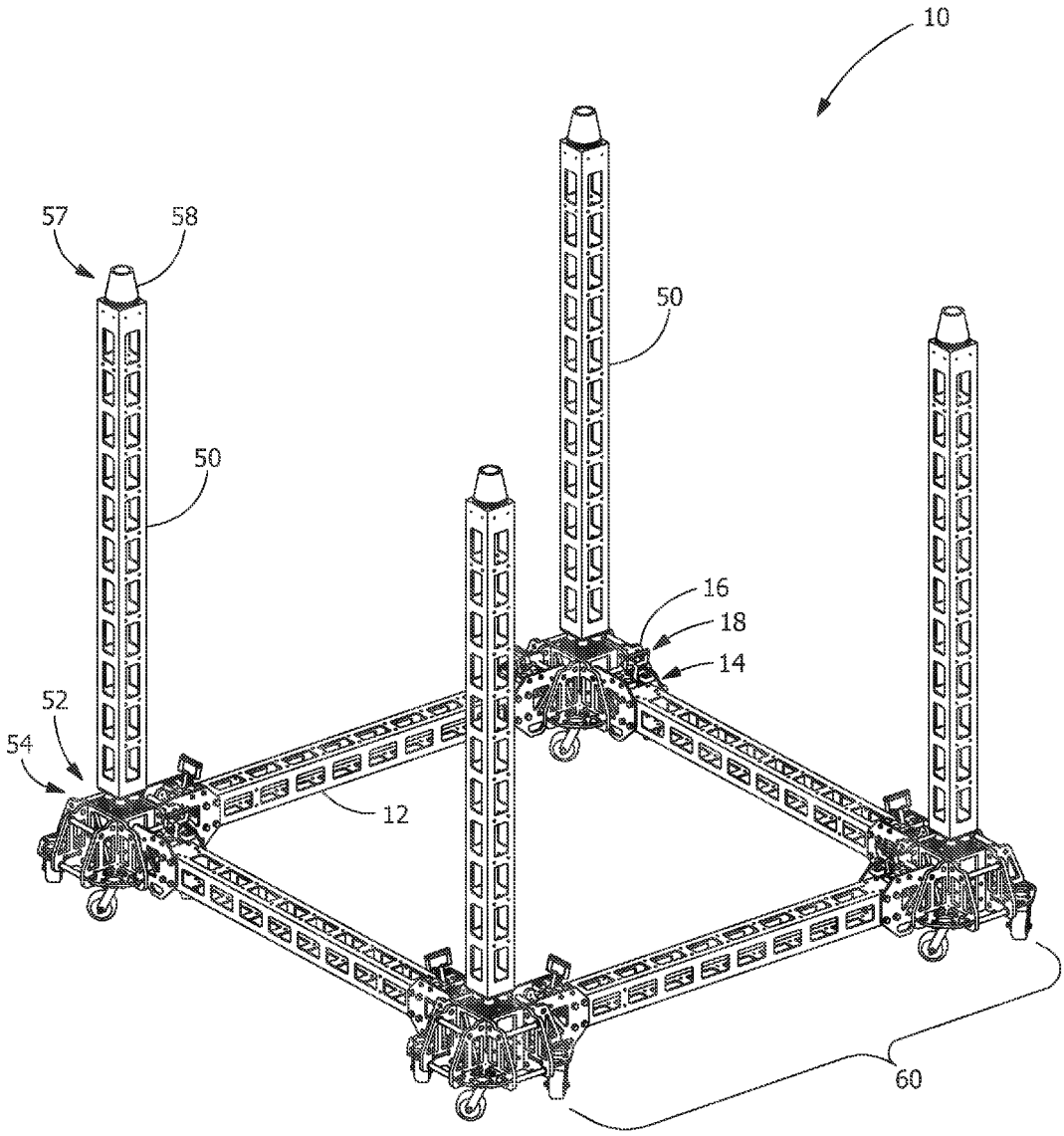
FIG. 5 illustrates an exemplary embodiment of the multiple beams and corresponding junction devices of FIG. 4 assembled together of a portable structure.

FIGS. 1A and 1B show different views of a junction device 16 for permitting beams 12, 50 (FIG. 5) to be rigidly engaged to each other to form a portable structure, such as portable structure 10 (FIG. 5). The selectably rigid engagements defining multi-point connections between junction device 16 and beams 12, 50 that are manually actuable and self-contained, are achieved by engagement features associated with each of junction device 16 and beams 12, 50 that will be discussed in further detail below.

Figure 1C:
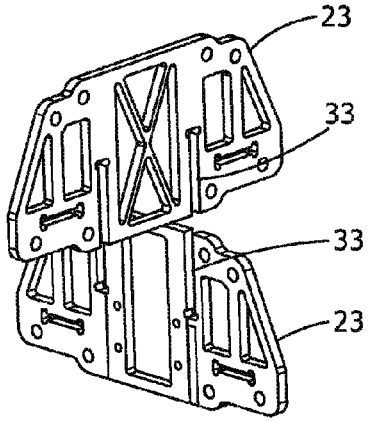
FIG. 1C illustrates an exploded upper perspective view of a pair of interlocking frame members of a junction device of the portable structure.

As further shown collectively in FIGS. 1A and 1B, junction device 16 includes a frame 20 having an outer frame portion 22 and an inner frame portion 44. As further shown in FIGS. 1A and 1B, outer frame portion 22 includes a plurality, such as four substantially orthogonally positioned interlocking frame members 23. The four substantially orthogonally positioned interconnecting or interlocking frame members 23 of outer frame portion 22 define a substantially rectangular opening 25 for receiving inner frame portion 44. In one embodiment, substantially rectangular opening 25 is a square opening, and inner frame portion 44 is also square. As shown collectively in FIGS. 1B and 1C, interlocking frame members 23 include corresponding mating slots 33 which define a tick-tack-toe profile 24 upon assembly. As further shown in FIG. 1A, individual frame members 23 define a substantially trapezoidal shape. In one embodiment, at least two frame members 23 are substantially identical to each other, and in another embodiment, each frame member 23 is substantially identical to each other. In another embodiment, at least one interconnecting frame member 23 does not define a substantially trapezoidal shape. In another embodiment, portions of the frame of the junction device are not arranged orthogonally. In another embodiment, more or less than four interlocking frame members are utilized.

As further shown in FIG. 1A, each frame member 23 includes opposed tabs 26 outwardly extending to opposed ends, which tabs 26 extending outwardly and away from opening 25 of outer frame portion 22. As shown, apertures 36 are formed in tabs 26 for receiving a lug 38 for lifting or otherwise manipulating junction device 16. As further shown in FIG. 1A, apertures 40 are also formed in tabs 26 for receiving fittings 116 associated with adjustable cables 122 (FIG. 25) for purposes of assembly of portable structures, as will be discussed in further detail below. Outer frame portion 22 further includes two pairs of substantially parallel frame members 23, each pair of substantially parallel frame members 23 being substantially mutually perpendicular to each other. Each pair of substantially parallel frame members 23 includes a pair of opposed substantially parallel tabs 26. Substantially perpendicular tabs 26 located adjacent to each other secure a caster assembly 32 therebetween, totaling four caster assemblies 32 (three caster assemblies are shown in FIG. 1A). The juncture of substantially perpendicular tabs 26 and caster assembly 32 defines a structural recess region 34 in which a component 42, such as a winch, LED, other light source, sound source, tool or other usable article associated with a performance may be positioned.

Figure 2:
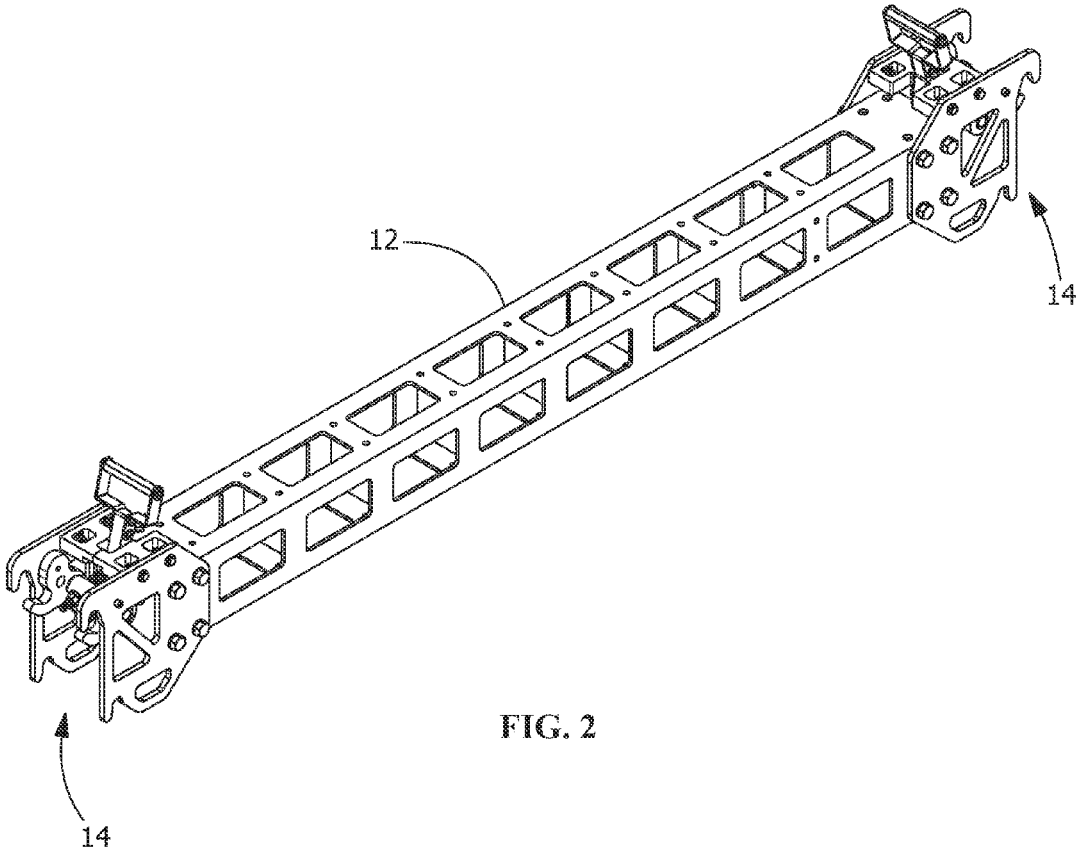
FIG. 2 illustrates an upper perspective view of an exemplary embodiment of a beam of a portable structure.

As further shown in FIG. 1A, extending between each pair of substantially parallel tabs 26 is a second engagement feature 18 for engaging a corresponding engagement feature 14 of beam 12 (FIG. 2). As shown, second engagement feature 18 includes a pin 28 positioned in close proximity between opposed caster assemblies 32. Second engagement feature 18 further includes a pin 30 extending between each pair of substantially parallel tabs 26. In other words, each of pin 28 and pin 30 comprise a second engagement feature portion of second engagement feature 18. As further shown in FIG. 1A, pins 28, 30 are positioned substantially parallel relative to each other. However, as shown in FIG. 1B, pin 28 is positioned at a greater distance to a corresponding wall, side wall or side 31 of opening 25 extending between substantially parallel tabs 26, as compared to the distance between side 31 and pin 30. In other words, pins 28, 30 are offset from each other relative to a corresponding side 31 of opening 25 formed in outer frame portion 22, permitting easier alignment with first engagement feature 14 of beam 12 (FIG. 2). In another embodiment, pins 28, 30 are not parallel to each other.

Figure 3:
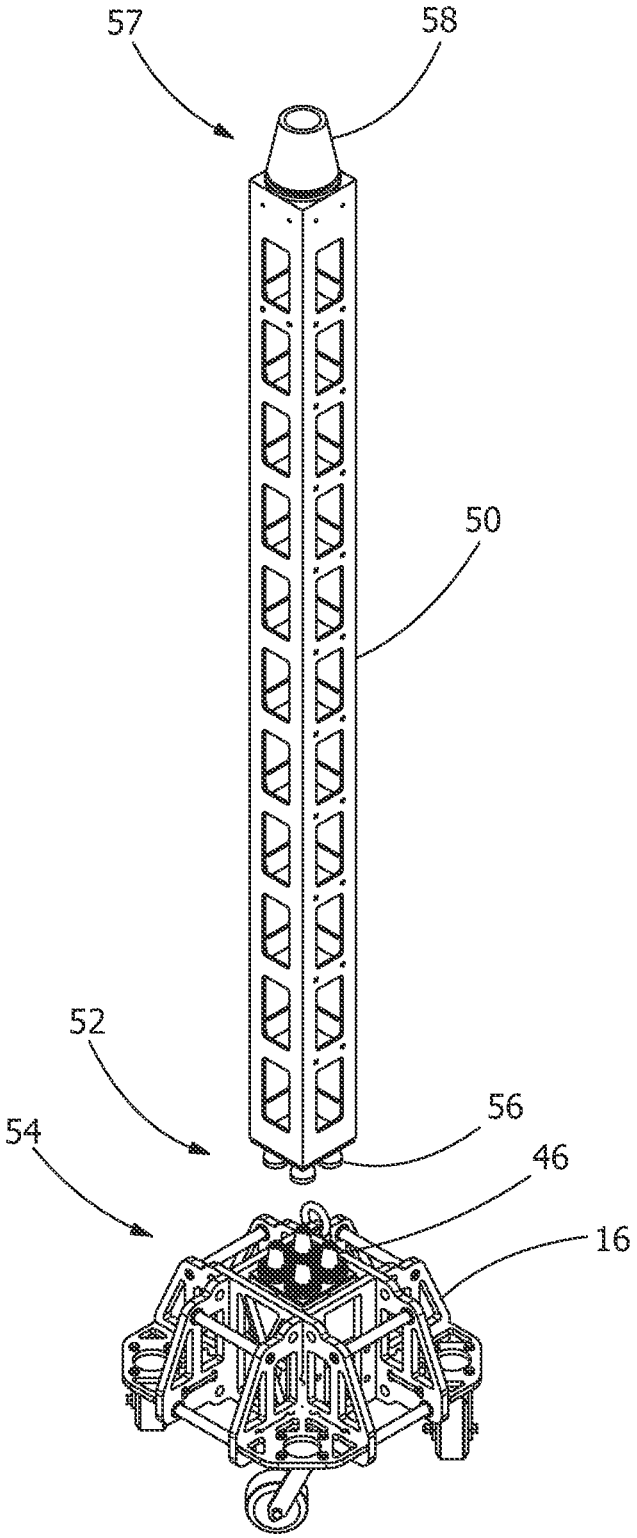
FIG. 3 illustrates an exploded upper perspective view of an exemplary embodiment of a beam and a junction device of a portable structure.
Figure 4:
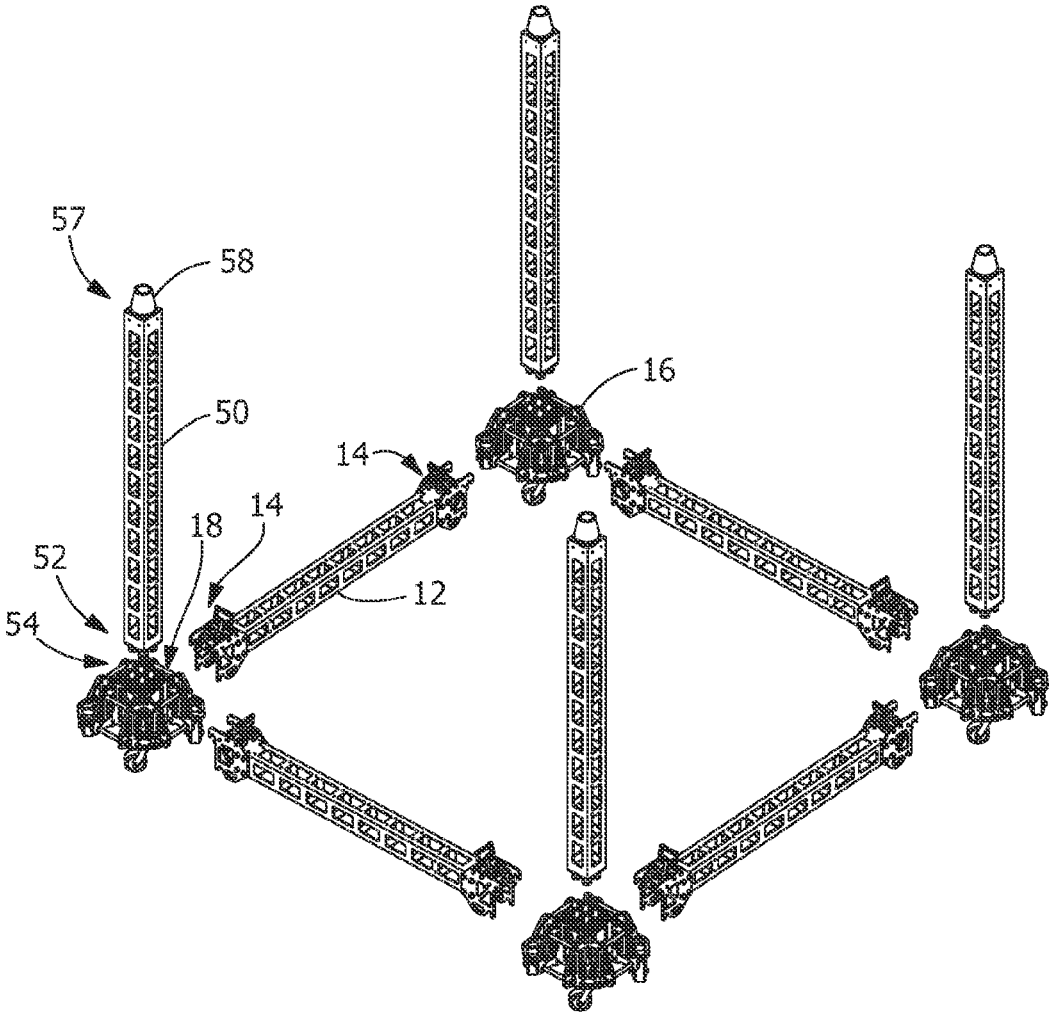
FIG. 4 illustrates an exploded upper perspective view of an exemplary embodiment of multiple beams and corresponding junction devices of a portable structure.
Figure 6:
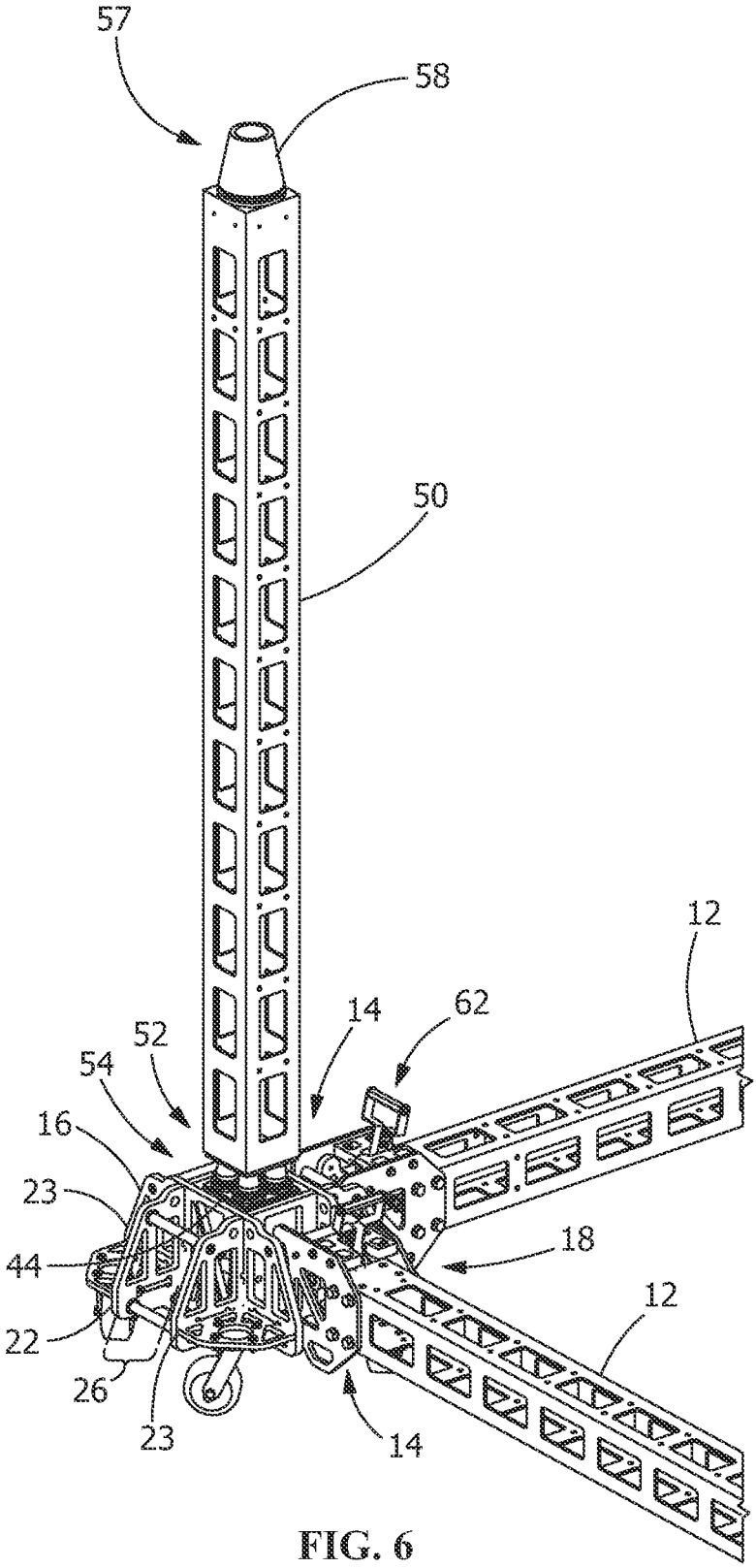
FIGS. 6 and 7 illustrate exemplary embodiments of different assembled configurations between beams and a corresponding junction device of a portable structure.
Figure 7:
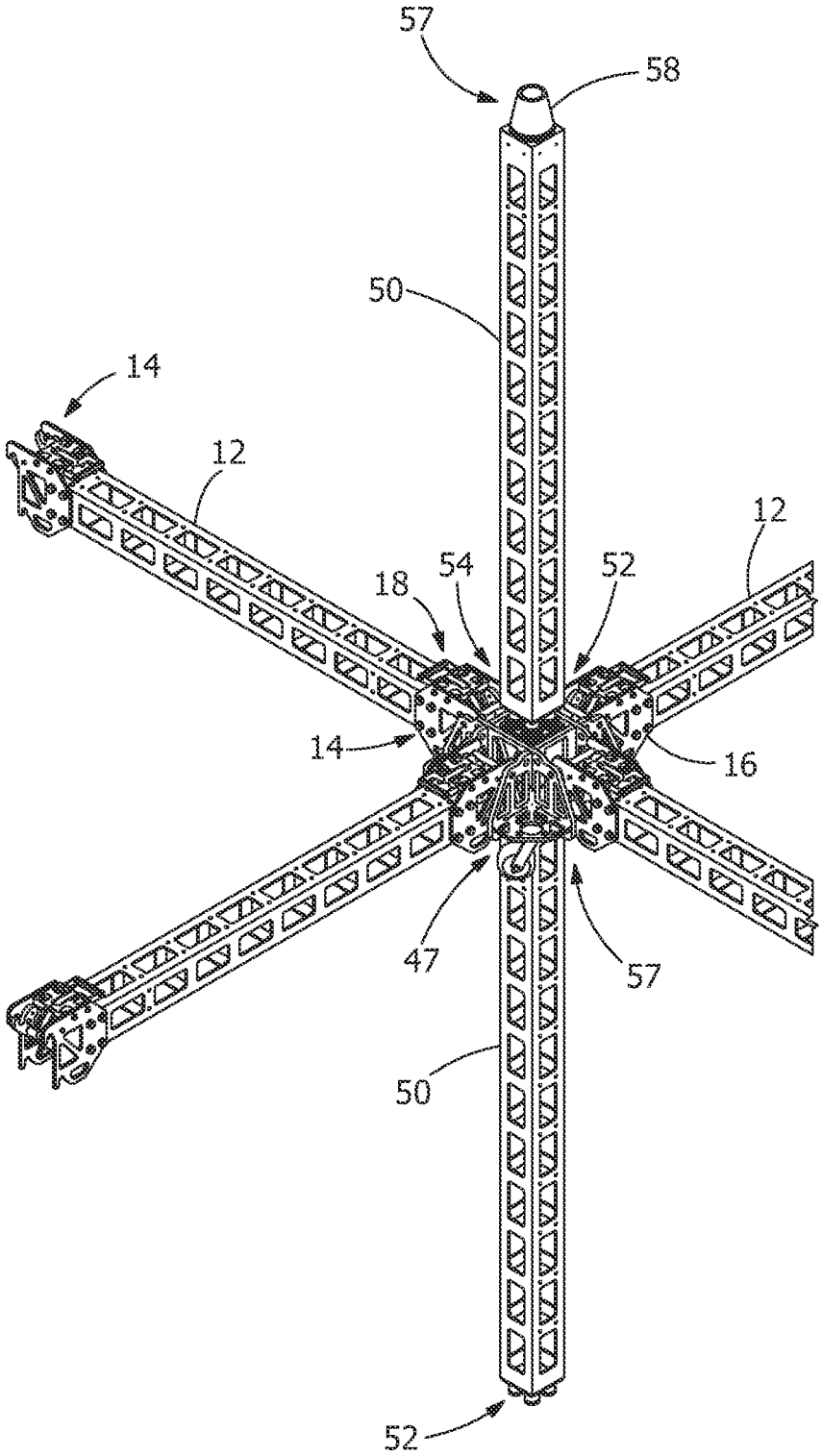
Figure 11:
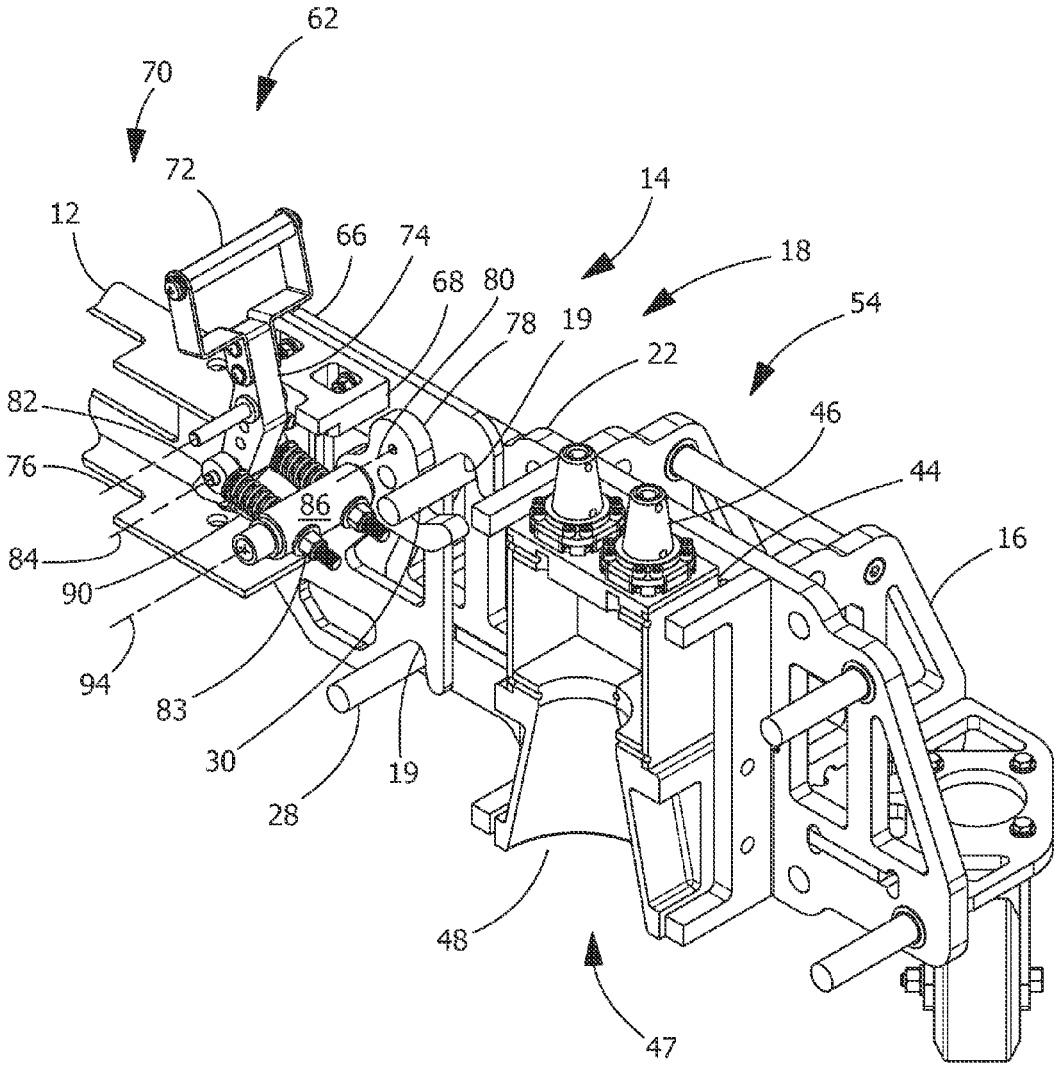
FIG. 11 illustrates an enlarged partial cross-section of FIG. 10 of a beam and a corresponding junction device of a portable structure.

As further shown collectively in FIGS. 1A, 3, 10 and 11, extending from one end of inner frame portion 44 of junction device 16 is a second engagement feature 54 for engaging a corresponding first engagement feature 52 of beam 50 (FIG. 3). Second engagement feature 54 includes a plurality of tapered members 46 extending outwardly from inner frame portion 44. As further shown in FIG. 19, a tapered member 46 may be configured to receive a corner fitting 110 of decking 96 for securing decking 96 to a portable structure. In addition to receiving corner fitting 110 of decking 96, tapered member 46 is also configured to be received in tapered members 56 of first engagement feature 52 (decking 96 not shown in FIG. 3). Extending from an opposed end of inner frame portion 44 is a second engagement feature 47 (FIG. 11). Second engagement feature 47 includes a tapered recess 48 that is configured to receive a first engagement feature 57 having a tapered member 58 extending outwardly from beam 50 (FIG. 3). As shown in FIGS. 6 and 7, beams 50 may extend substantially vertically, utilizing gravitational forces to maintain engagement between corresponding engagement features 52, 54, as well as between engagement features 47, 57. In an alternate embodiment in which engagement features 47, 54 of junction device 16 may be configured similarly to engagement feature 18, each engagement feature of junction device 16 can have a corresponding or mating engagement feature forming an assembled joint that be rigidly engaged together.

As shown collectively in FIGS. 2, 5, 9A, 9B, 10 and 11, the engagement features 14, 18 between respective beam 12 and junction device 16 for assembling/disassembling a portable structure 60 (FIG. 5) is now discussed. As shown in FIG. 2, beam 12 includes opposed first engagement features 14. First engagement features 14 are configured to receive second engagement features 18 of junction device 16. More specifically, as further shown collectively in FIGS. 9A, 9B, and 11, first engagement features 14 include a pair of first engagement feature portions 19, such as hooks that are configured to receive corresponding pins 28, 30 of second engagement features 18 of junction device 16. First engagement feature portions 19 include corresponding tapered portions 21 that more easily permit alignment and engagement with corresponding pins 28, 30 of second engagement features 18. In one embodiment, first engagement feature portions 19 of first engagement features 14 of beam 12 and corresponding pins 28, 30 of second engagement features 18 of junction device 16 are sized and arranged to permit selectable engagement between aligned first engagement features 14 and second engagement features 18 by minimally raising and guiding only one end of beam 12, the other end of the beam 12 remaining in contact with the ground or assembly area.

Figure 9A:
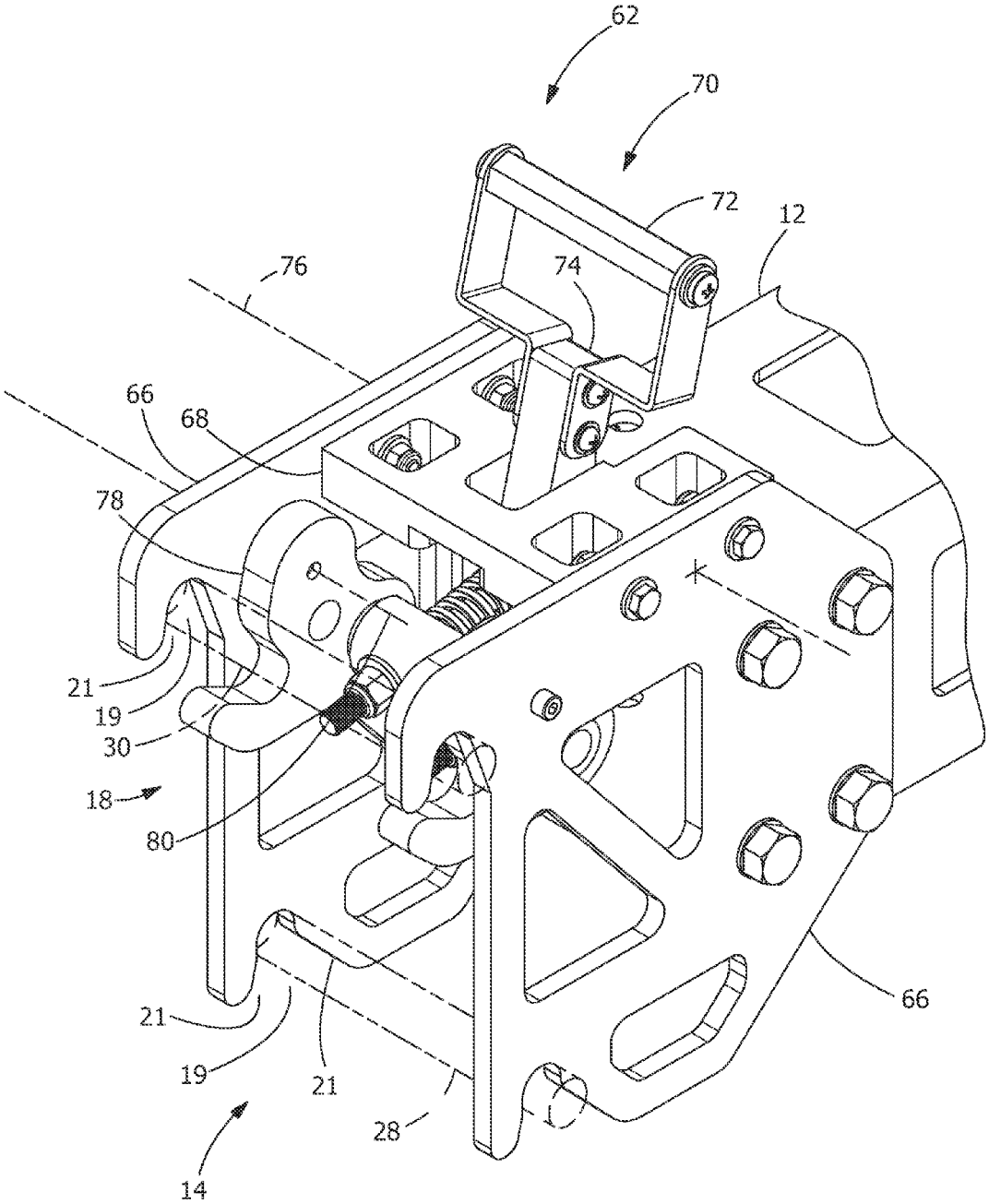
FIGS. 9A and 9B illustrate an exemplary embodiment of respective disengaged and engaged positions of an engagement feature of a beam of a portable structure.
Figure 9B:
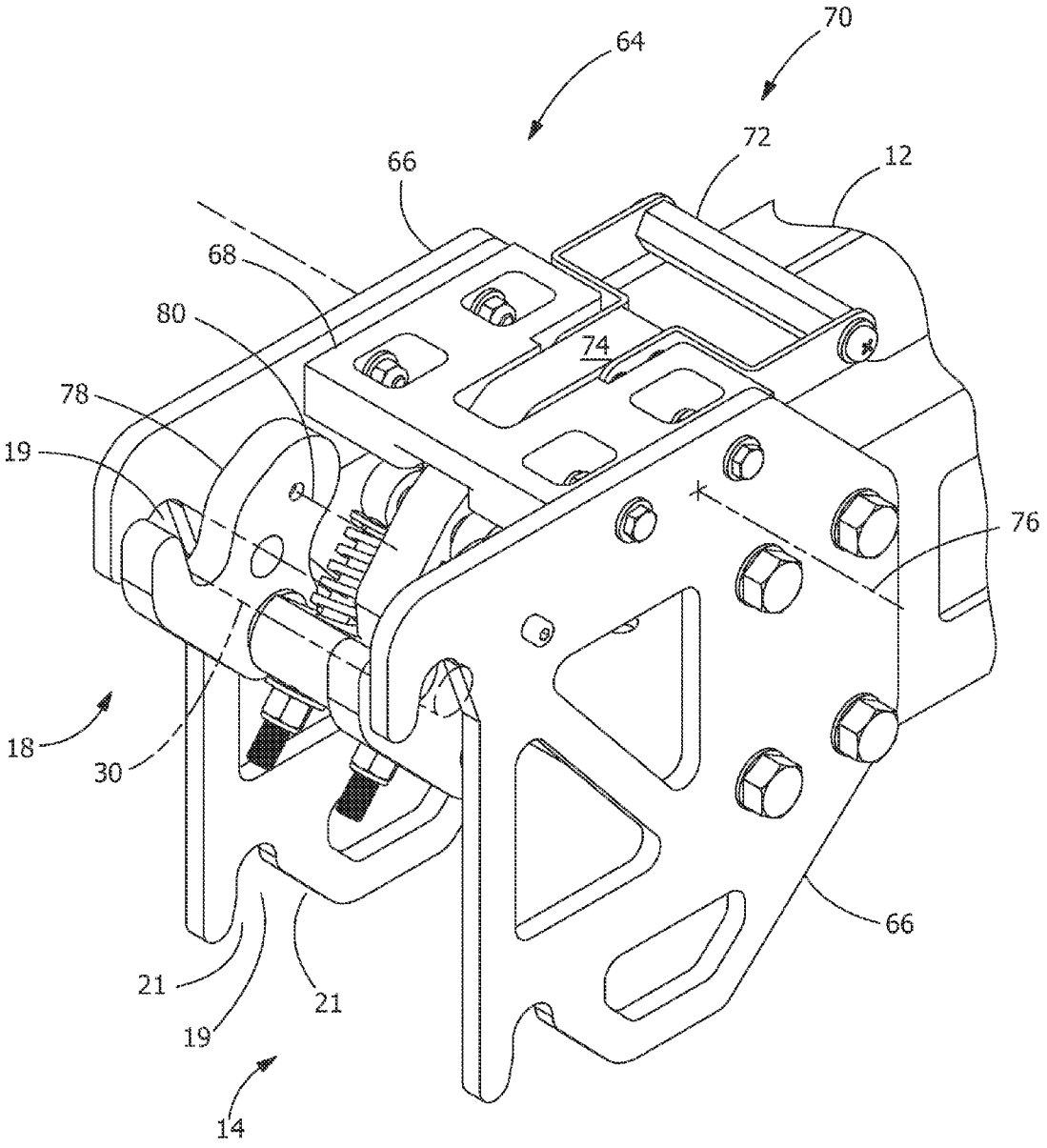
Figure 10:
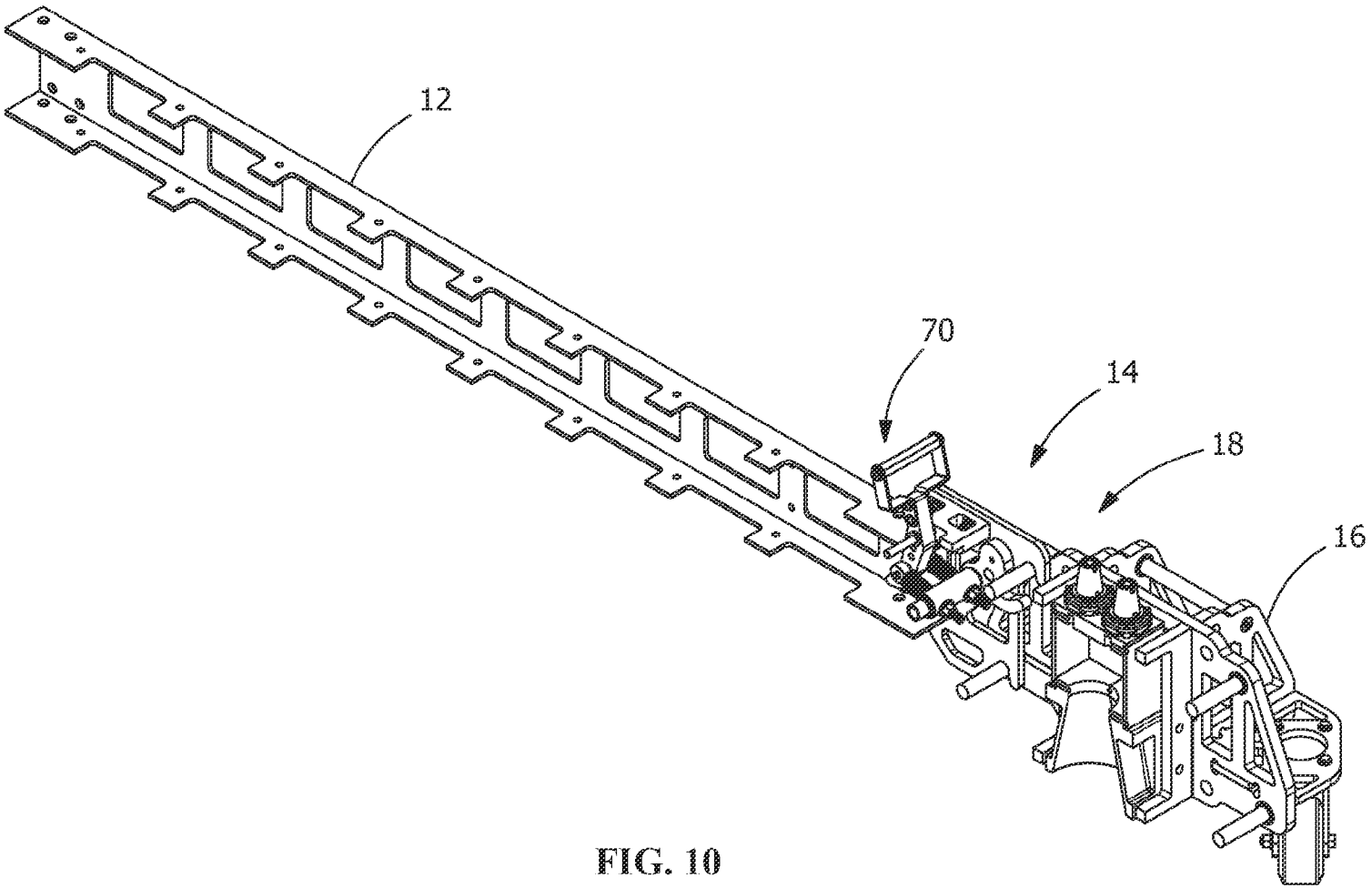
FIG. 10 illustrates an exemplary embodiment of an upper perspective cross-sectional view of a beam and a corresponding junction device of a portable structure.
Figure 17:
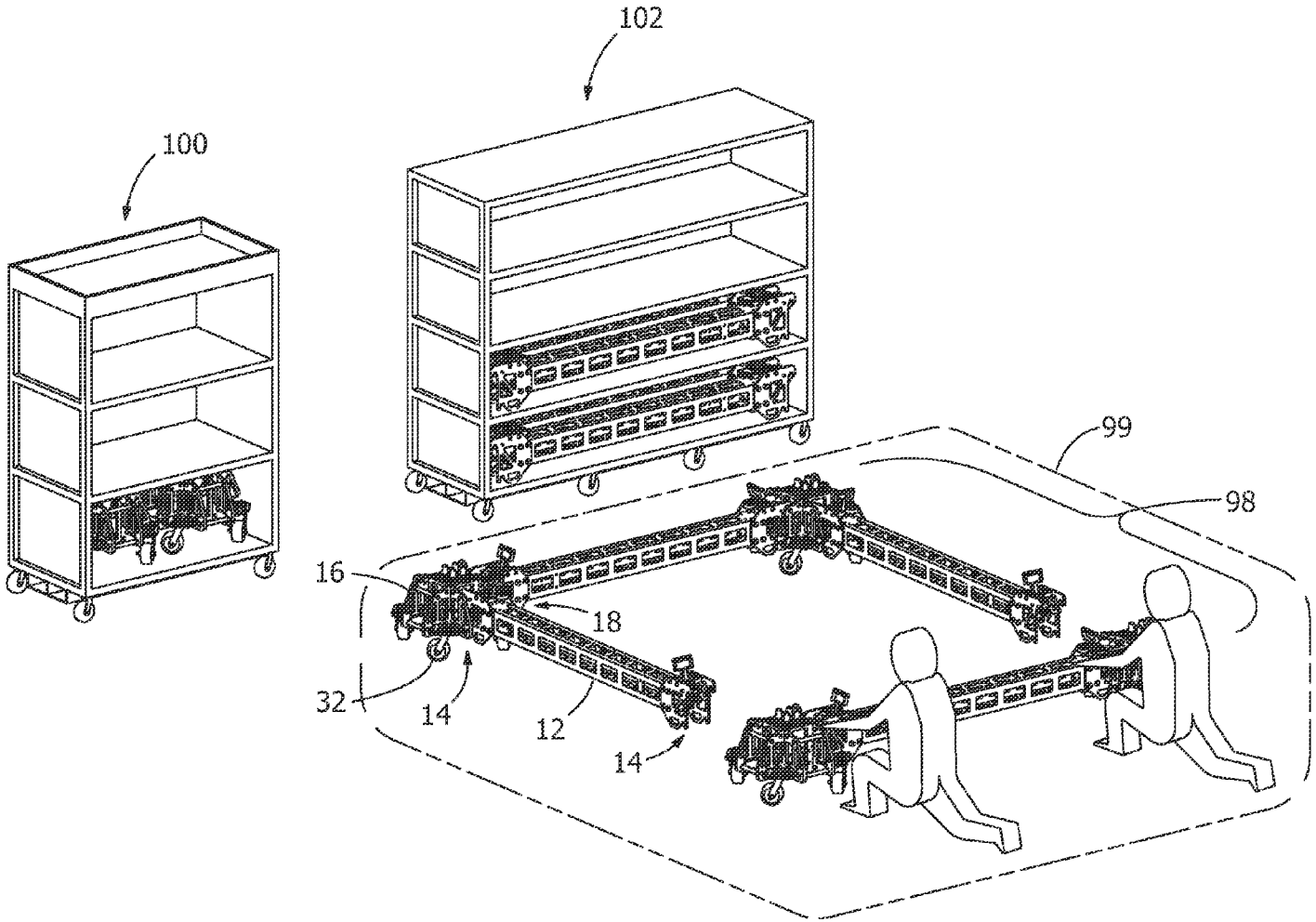
FIGS. 17 and 18 illustrate an exemplary embodiment of an upper perspective view during assembly of a plurality of components of a portable structure.

Stated another way, as generally shown in FIG. 17 which generally depicts assembly of a plurality of corresponding beams 12 and junction devices 16 on a substantially level assembly area 99 as part of constructing a portable structure, once corresponding first and second engagement features 14, 18 are brought into alignment, such as by urging junction device 16 into guided rotational movement of caster assemblies 32 over assembly area 99, only the one end of beam 12 must be minimally raised and guided to achieve engagement between the corresponding beam 12 and junction device 16. Upon achieving engagement between respective first and second engagement features 14, 18, as shown in FIGS. 9A and 9B, articulating linkage 70 is manually actuated from a disengaged position 62 to an engaged position 64. Upon articulating linkage 70 achieving engaged position 64 (FIG. 9B), engagement feature portion 78 of articulating linkage 70 rigidly engages pin 30, thereby rigidly engaging first engagement feature 14 of beam 12 to second engagement feature 18 of junction device 16. The resulting rigid engagement between first engagement feature 14 of beam 12 to second engagement feature 18 of junction device 16 defines a multi-point connection, with first and second engagement features 14, 18 and manually actuatable articulating linkage 70 being self-contained.

The terms manually actuated, manually actuatable and the like are intended to refer to the physical capabilities of an individual normally tasked with assembly and/or disassembly of a portable structure of the present disclosure, including the beams and junction devices such as previously discussed. That is, this individual, sometimes referred to as a "roadie", would easily be able to, at the least, routinely apply sufficient force without the aid of tools to actuate the articulating linkage between engaged and disengaged positions, which articulating linkage achieving rigid engagement between corresponding engagement features of beams and junction devices.

The term self-contained is intended to mean that the engagement features associated with assembly and/or disassembly of a portable structure of the present disclosure, including the articulating linkage utilized to rigidly secure or engage corresponding engagement features to each other, are complete in and of themselves or otherwise wholly or all inclusive, i.e., not requiring additional components or parts.

The term multi-point connection is intended to refer to the resulting rigidly engaged joint between assembled engagement features. Each of the engagement features includes at least two engagement feature portions that mutually engage each other. That is, each multi-point connection between corresponding engagement features between a beam and a junction device includes at least two sets of an individual engagement portion of an engagement feature of a beam engaging a corresponding individual engagement portion of a corresponding engagement feature of a junction device.

The term rigidly engaged is intended to refer to an assembled joint or connection between corresponding engagement features of a beam and a junction device. The engagement features are secured in an assembled condition by articulating linkage capturing at least one engagement feature portion of an engagement feature, preventing disassembly of the corresponding engagement features from each other. The resulting assembled joint or connection does not permit movement of the beam relative to the junction device.

As shown collectively in FIGS. 1A, 6 and 7, as a result of corresponding engagement features between beams 12, 50 and junction device 16, beams 12, 50 extend substantially orthogonally relative to each other, with beams 50 extending substantially vertically. It is to be understood that the present disclosure includes portable structures forming three-dimensional rectangular, and in other embodiments also include portable structures forming one or more free-standing or interconnected three-dimensional cubes. In other embodiments, the corresponding engagement features between beams 12, 50 and junction device 16 may be configured such that beams 12, 50 extend non-orthogonally relative to each other, and/or with beams 50 extending non-vertically. In one embodiment, junction device 16 may be constructed such that all second engagement features are the same. In another embodiment, all second engagement feature portions are pins, while in yet another embodiment all second engagement feature portions are hooks. In a further embodiment, at least one second engagement feature includes a second engagement feature portion that is different from another second engagement feature portion, such as a pin and a hook. It is to be understood that the engagement features can include other engagement arrangements other than pins and/or hooks, such as protrusions that slidably engage corresponding slots.

However, as shown in FIG. 6, for example, junction device 16 may be utilized to form different structural joint configurations. FIG. 6 shows a junction device 16 having a pair of second engagement features 18 for connecting with or engaging first engagement features 14 of a pair of beams 12. Further, junction device 16 includes an additional second engagement feature 54 associated with an inner frame portion 44 that is secured to outer frame portion 22. Second engagement feature 54 connects with or engages first engagement feature 52 of beam 50. The engagements between corresponding engagement features of junction device 16 with the engagement features of the pair of beams 12 and beam 50 collectively define a corner joint.

As a result, a junction device 16 usable only for similarly configured corner joints would only require interlocking frame members 23 having two adjacent pairs of parallel tabs 26 (not four pairs of parallel tabs 26 as shown in FIG. 6). One of ordinary skill in the art would understand that an alternate construction of junction device 16 similar to that described above could be used to form a "T" structural joint configuration. To form an exemplary "T" joint, beams 12 may be positioned in axial alignment relative to one another, versus being transversely arranged relative to one another as shown in FIG. 6. A junction device 16 usable only for similarly configured "T" joints would only require interlocking frame members 23 having two opposed pairs of parallel tabs 26 (not four pairs of parallel tabs 26 as shown in FIG. 6).

As shown collectively in FIGS. 2, 9A, 9B, and 10-14, articulating linkage 70 which achieves a fail-safe rigid engagement or connection or joint between engagement features 14, 18 securing beams 12 and junction devices 16 together is now discussed. As further collectively shown in FIGS. 2, 9A, 9B, and 10-14, articulating linkage 70 is positioned between opposed plates 66 defining first engagement feature 14 of beam 12. Articulating linkage 70 includes a crank 74 pivotably connected about an axis 76 formed in a block 68 positioned between opposed plates 66. A handle 72 is positioned at one end of crank 74 and a pair of fasteners 82, such as eye bolts, is pivotably connected about an axis 84 formed near an opposed end 92 of crank 74.

Figure 12:
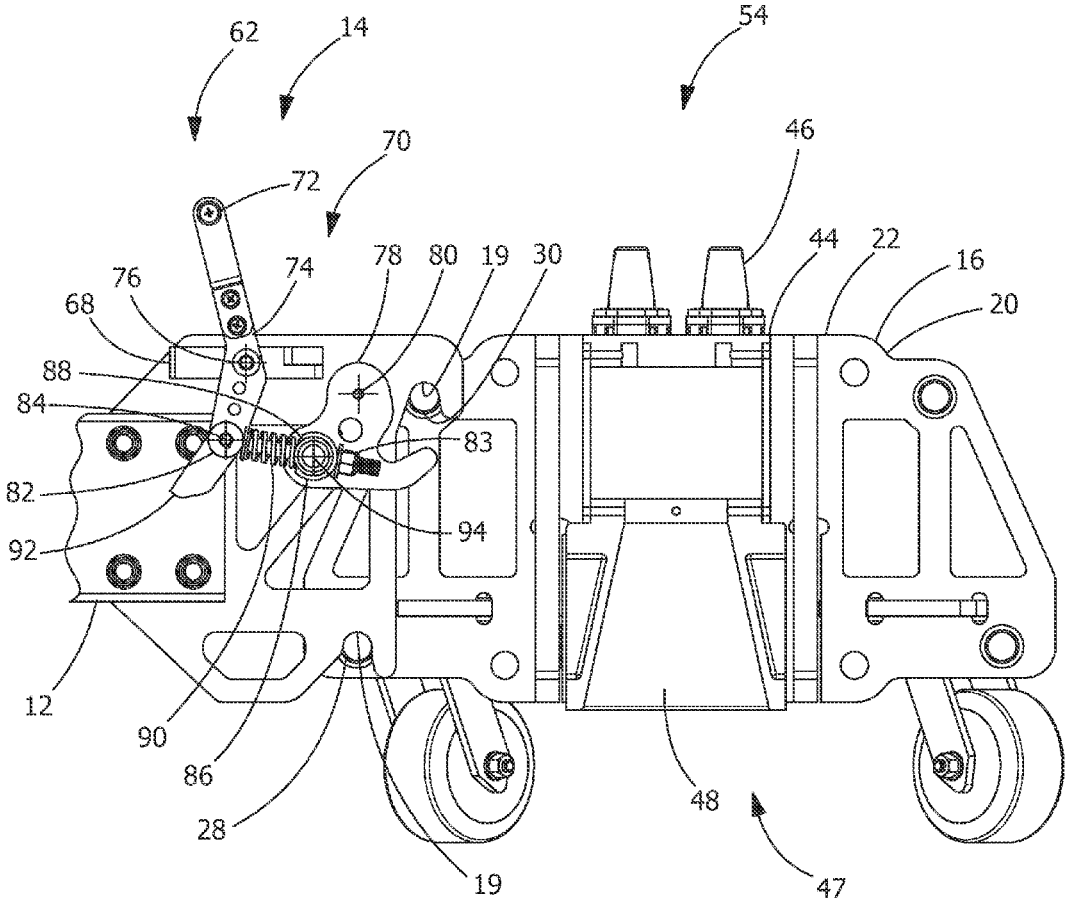
FIG. 12 illustrates an exemplary embodiment of an enlarged partial side cross-sectional view of a beam and a corresponding junction device similar to FIG. 11, except taken along a side view of a portable structure.
Figure 13:
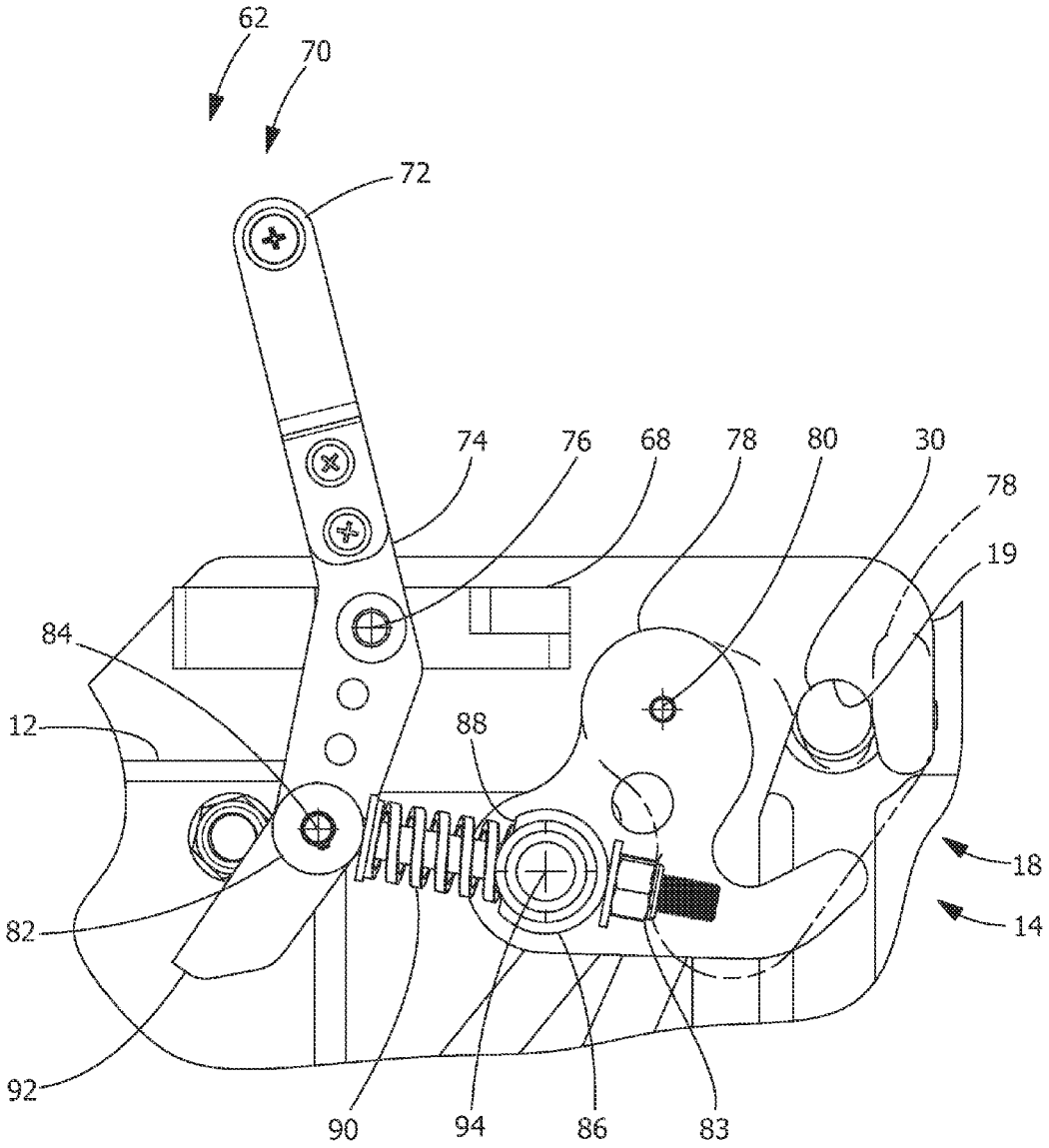
FIG. 13 illustrates an enlarged partial side cross-sectional view of the junction device of FIG. 12 in a disengaged position of a portable structure.

Fasteners 82 extend from axis 84 through a substantially cylindrical member 86 having a rotational axis 94. Fasteners 82 extend through respective springs 90 positioned between axis 84 and substantially cylindrical member 86, one end of springs 90 opposite axis 84 abutting a substantially flat bearing surface 88 formed in substantially cylindrical member 86. A nut 83 is sufficiently threadedly engaged onto each of fasteners 82 for subjecting spring 90 to a predetermined compressive force or pre-load. Each of opposed ends of substantially cylindrical member 86 pivotably engage engagement feature portion 78 about rotational axis 94. Each of engagement feature portions 78 rotate about an axis 80 operatively connected to respective opposed plates 66. FIGS. 11-13 show articulating linkage 70 in a disengaged position 62, in which handle 72 extends above block 68 such that pin 30 of second engagement feature 18 can be brought into engagement or disengaged from first engagement feature portion 19 of first engagement feature 14. In one embodiment, in disengaged position 62, crank 74 abuts an end of beam 12, thereby limiting the amount of rotational movement about axis 76 and the extent handle 72 angularly extends above block 68.

Figure 8:
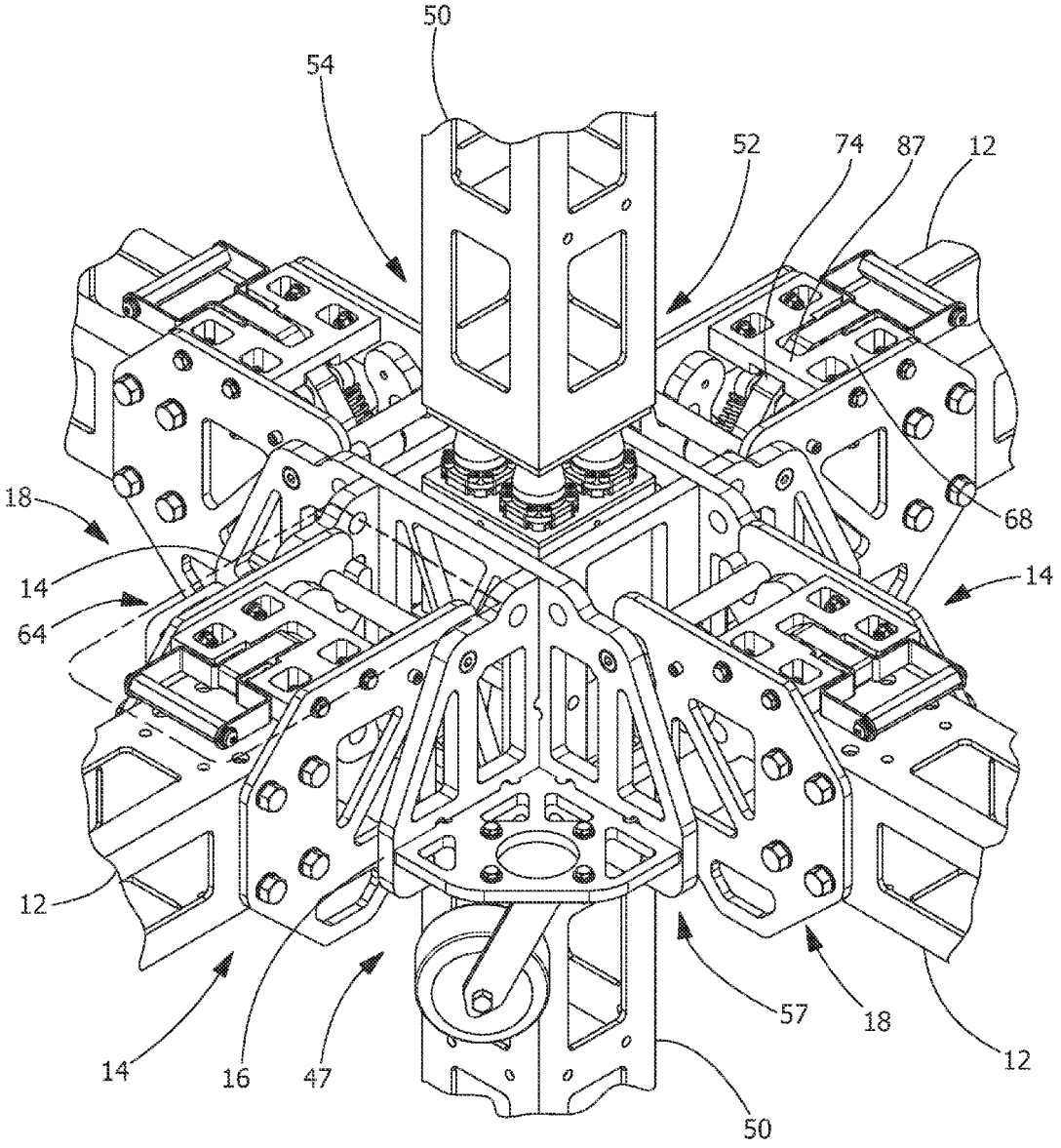
FIG. 8 illustrates a partial, enlarged upper perspective view of assembled beams and a corresponding junction device of FIG. 7 of a portable structure.
Figure 14:
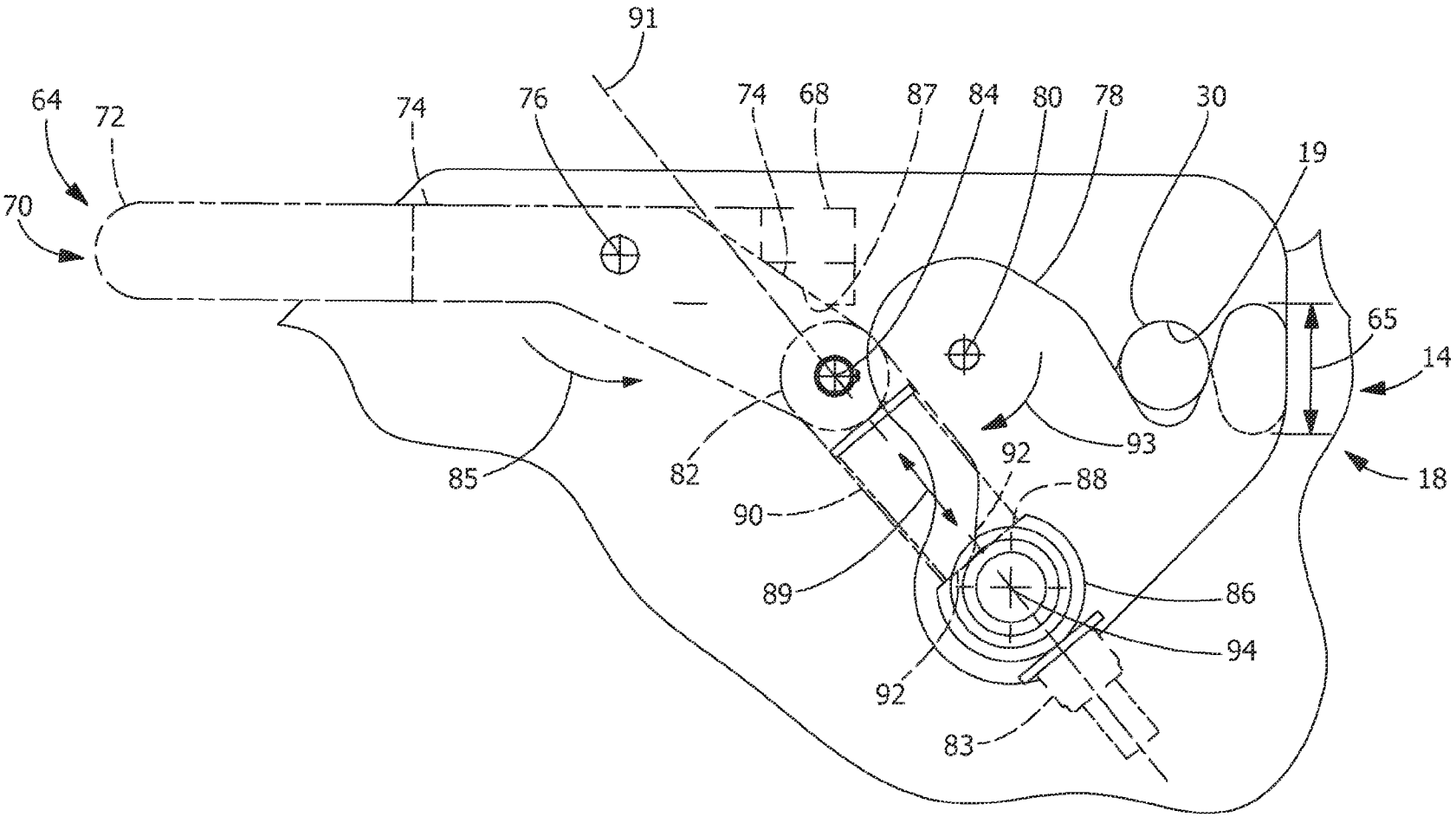
FIG. 14 illustrates an enlarged partial side cross-sectional view of the junction device of FIG. 12 in an engaged position of a portable structure.

Collectively, FIGS. 8 and 14 show articulating linkage 70 located in an engaged position 64. That is, crank 74 is rotated about axis 76 in a rotational movement direction 85 from disengaged position 62 toward block 68. As further shown in FIG. 8, when articulating linkage 70 is located in engaged position 64, the outside surface of handle 72 is substantially parallel or flush with the outside surface of block 68. In one embodiment, as shown in FIG. 8, a web 87 formed in block 68 abuts crank 74, thereby preventing further rotation of crank 74 in rotational movement direction 85 toward beam 12. FIG. 14 shows the positions and orientations of crank 74, fasteners 82, substantially cylindrical member 86 and engagement feature portion 78, when articulating linkage 70 is located in engaged position 64, as a result of the geometric interrelationships previously discussed. As further shown in FIG. 14, in engaged position 64, engagement feature portion 78 and first engagement feature portion 19 define an overlap 65, effectively capturing and maintaining pin 30 in a rigidly engaged position therebetween.

As further shown in FIG. 14, articulating linkage 70 includes a fail-safe locking feature that prevents disengagement between engagement feature portion 78 and first engagement feature portion 19 while the articulating linkage 70 is located in engaged position 64. Articulating linkage 70 includes an over-center latching feature in which upon articulating linkage 70 being placed in engaged position 64, spring 90 is compressed, applying a retention force 89 along line-of-force 91 that attempts to urge crank 74 in rotational movement direction 85, which rotational movement direction 85 being prevented as a result of abutting contact between web 87 of block 68 and crank 74. Moreover, due to the geometry of crank 74, and more specifically of the extended length and orientation of crank 74, terminating in end 92, a force generated through pin 30 against engagement feature portion 78 resulting in rotational movement direction 93 about axis 80 would be prevented prior to inadvertent disengagement of pin 30 from between first engagement feature portion 19 and engagement feature portion 78. That is, as configured and shown in FIG. 14, only a small amount of rotational movement of engagement feature portion 78 in rotational movement direction 93 about axis 80 could occur before end 92 of crank 74 would abut bearing surface 88, preventing further movement in rotational movement direction 93. This novel fail-safe construction has been tested under loading conditions resulting in structural failure. Such test results confirmed that structural failure would not occur at the engagement features. That is, the structural joints established between corresponding engagement features are more robust than the surrounding structure, and thus structural failure would occur at locations other than the structural joints corresponding to the engagement features.

It is to be understood that while the articulating linkage is shown as being operatively connected or otherwise associated with engagement features of the beam, one having ordinary skill in the art would realize that the articulating linkage could alternately be operatively connected or otherwise associated with engagement features of the junction device.

Figure 15:
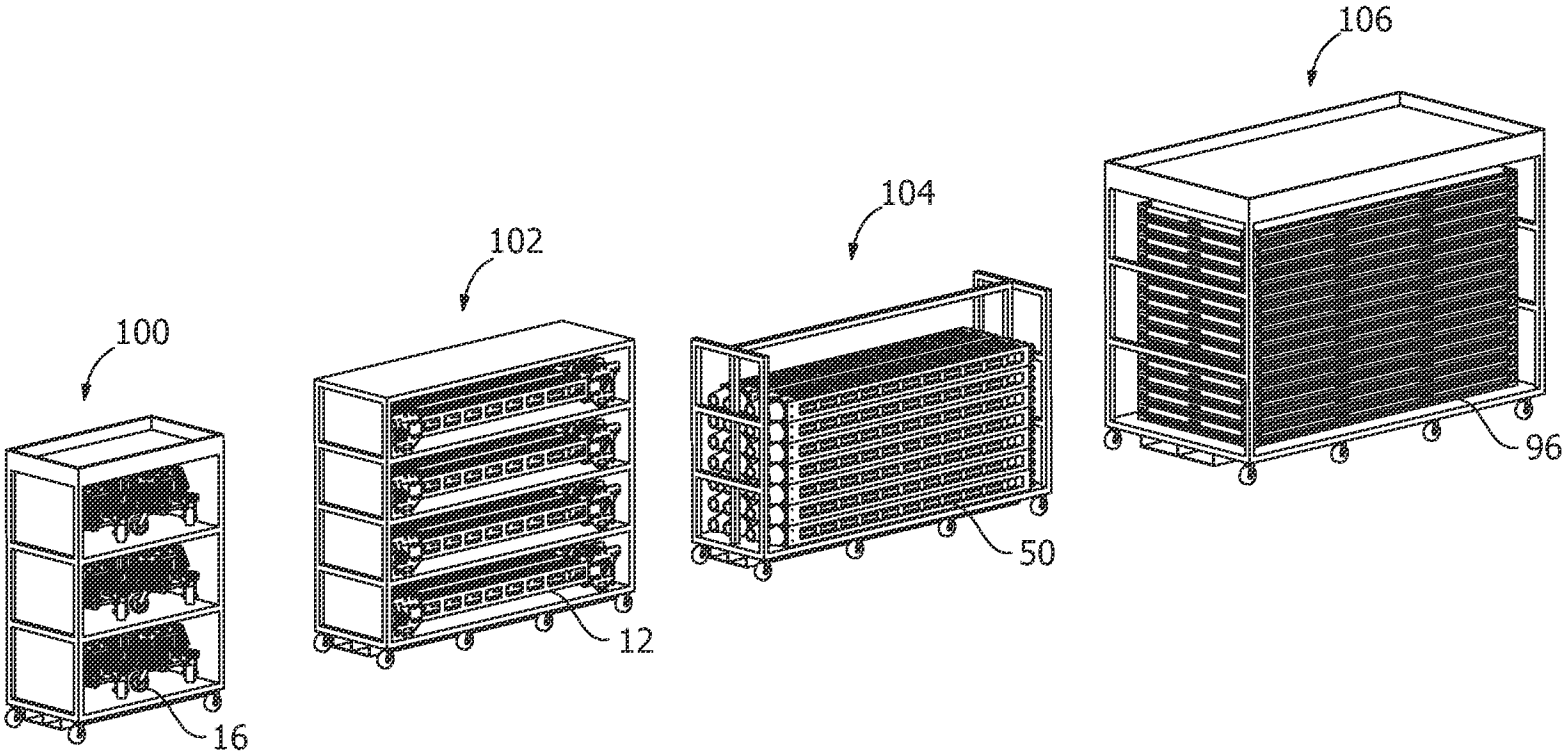
FIG. 15 illustrates an exemplary embodiment of an upper perspective view of an arrangement of a plurality of carted components of a portable structure.
Figure 16:
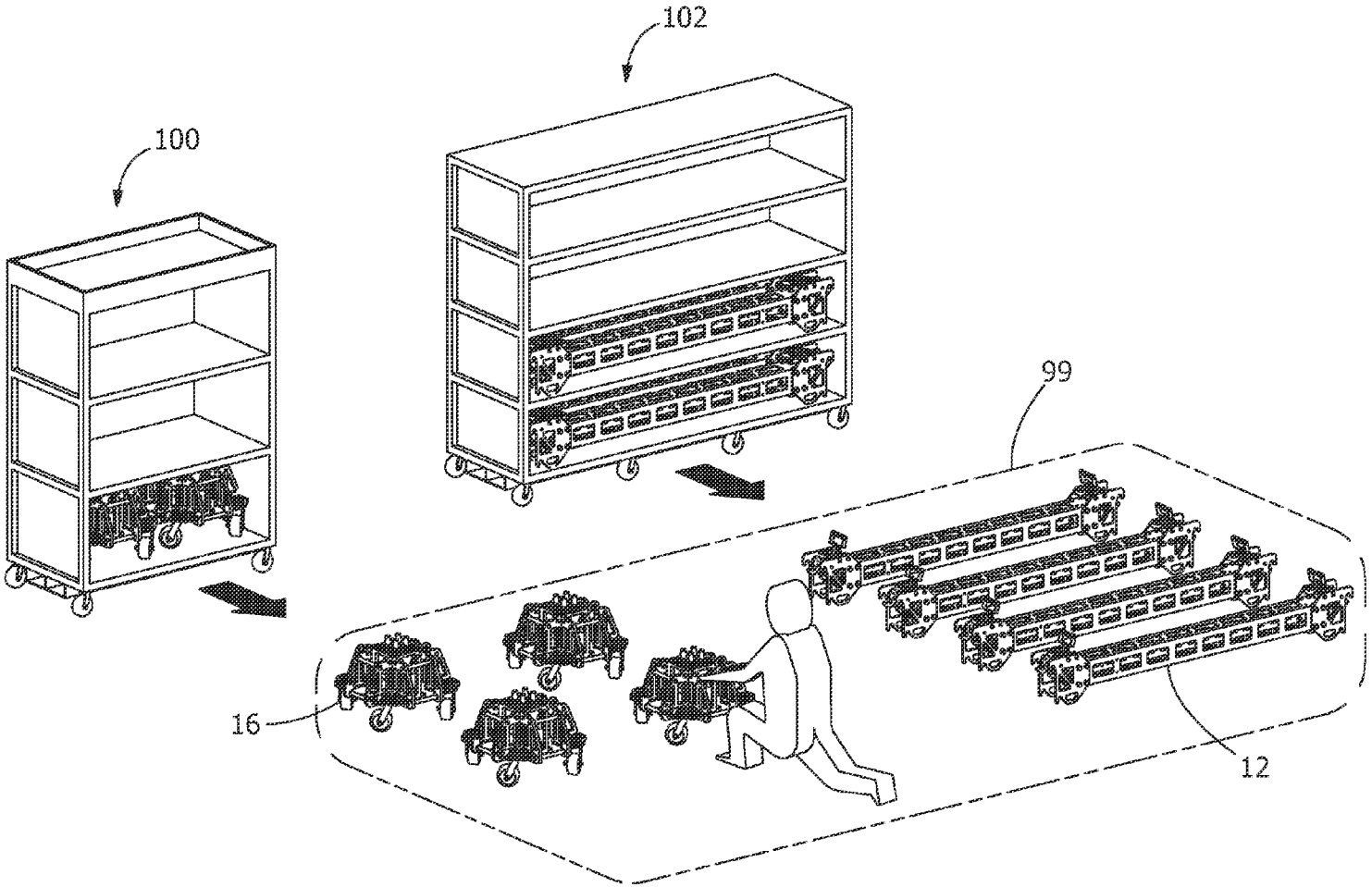
FIG. 16 illustrates an exemplary embodiment of an upper perspective view of an arrangement of a plurality of components provided for assembly of a portable structure.

FIGS. 15-30 relate to assembly/disassembly of a portable structure constructed primarily of components in a manner previously discussed. For example, FIG. 15 shows the provision of carts 100, 102, 104, and 106 each cart respectively containing a plurality of junction devices 16, beams 12, beams 50 and decking members or decking 96 in preparation of assembly of a portable structure. As shown in FIG. 16, once the plurality of component-laden carts 100, 102, 104, and 106 have been provided, a plurality of junction devices 16 and beams 12 are removed from respective carts 100, 102 and arranged in assembly area 99, such as a substantially smooth and level region conducive to assembly/disassembly of the components.

Figure 18:
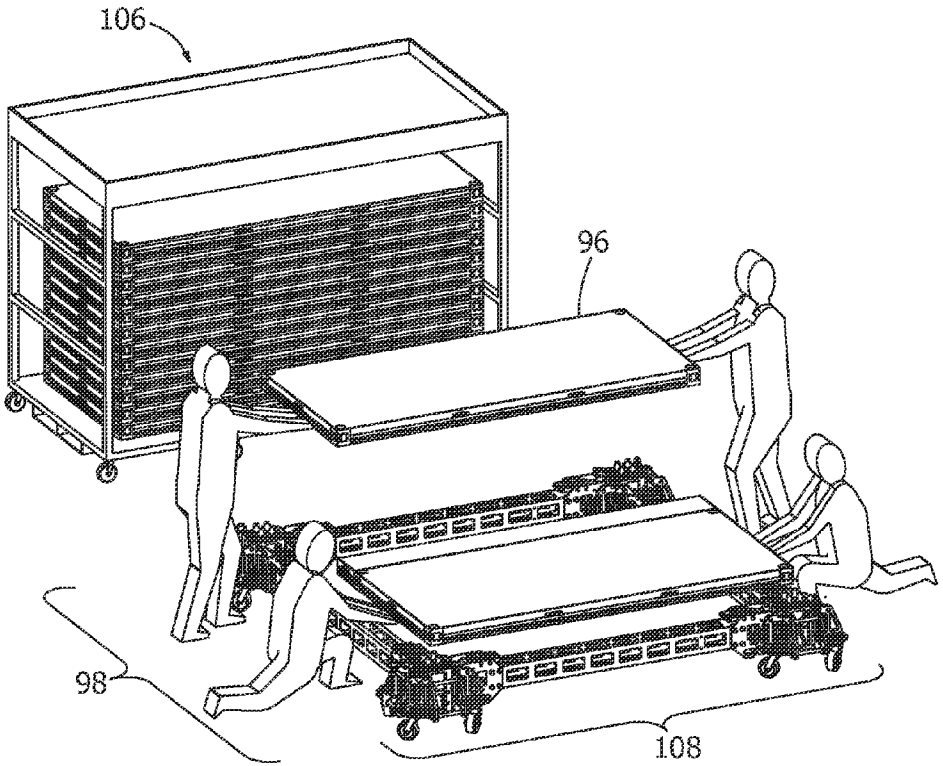
Figure 19:
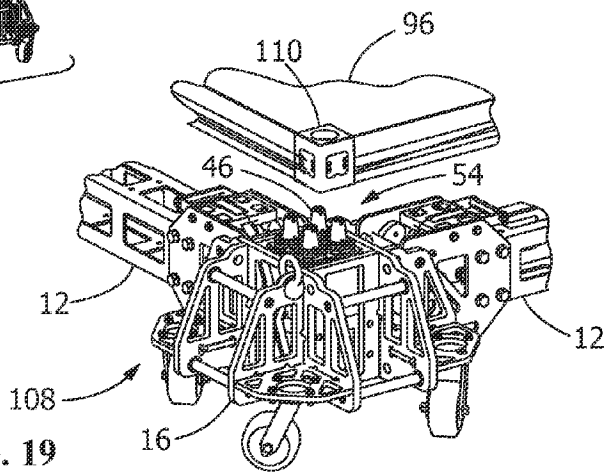
FIG. 19 illustrates an exemplary embodiment of an enlarged partial view taken from FIG. 18 of a portable structure.
Figure 23:
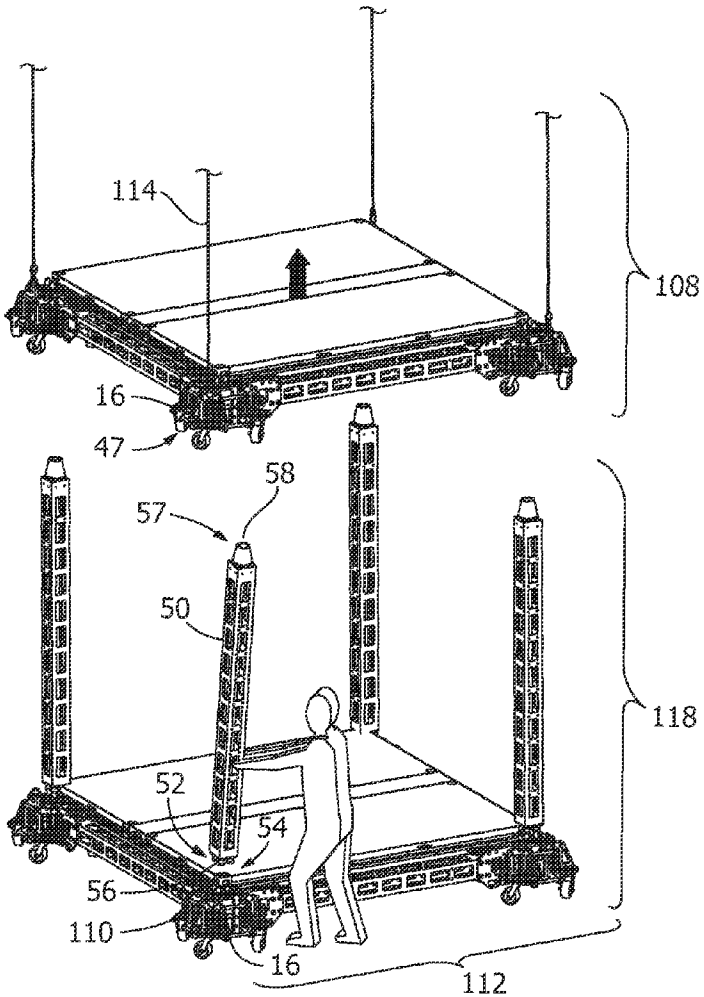
FIGS. 23 and 24 illustrate an exemplary embodiment of an upper perspective view during assembly of adjacent tiers of a portable structure.

As shown in FIG. 17, once a plurality of junction devices 16 and beams 12 are arranged in assembly area 99, corresponding first and second engagement features 14, 18 of respective beams 12 and junction devices 16 are directed toward each other (which includes bringing respective beams 12 and junction devices 16 into mutual alignment), and then brought into mutual engagement with each other to form a first tier 98 of the portable structure. As shown, one or more individuals may be utilized to perform these tasks. As further shown in FIG. 18, first tier 98 may include a layer of decking 96, the combined first tier 98 and layer of decking 96 being designated as a first tier 108. As shown in FIG. 19, at least one corner fitting 110 engages a tapered member 46 of second engagement feature 54 of junction device 16. As shown in FIG. 18, decking 96 includes four corner fittings 110 to be engaged with corresponding tapered members 46 to secure decking 96 to first tier 108. As shown in FIG. 23, it is to be understood that corner fitting 110 is sized and configured such that collective engagement between first engagement feature 52 of beam 50 and second engagement feature 54 of junction device 16 is not affected. Stated another way, irrespective of whether decking 96 is utilized or not, collective engagement between first engagement feature 52 of beam 50 and second engagement feature 54 of junction device 16 is not affected.

Figure 20:
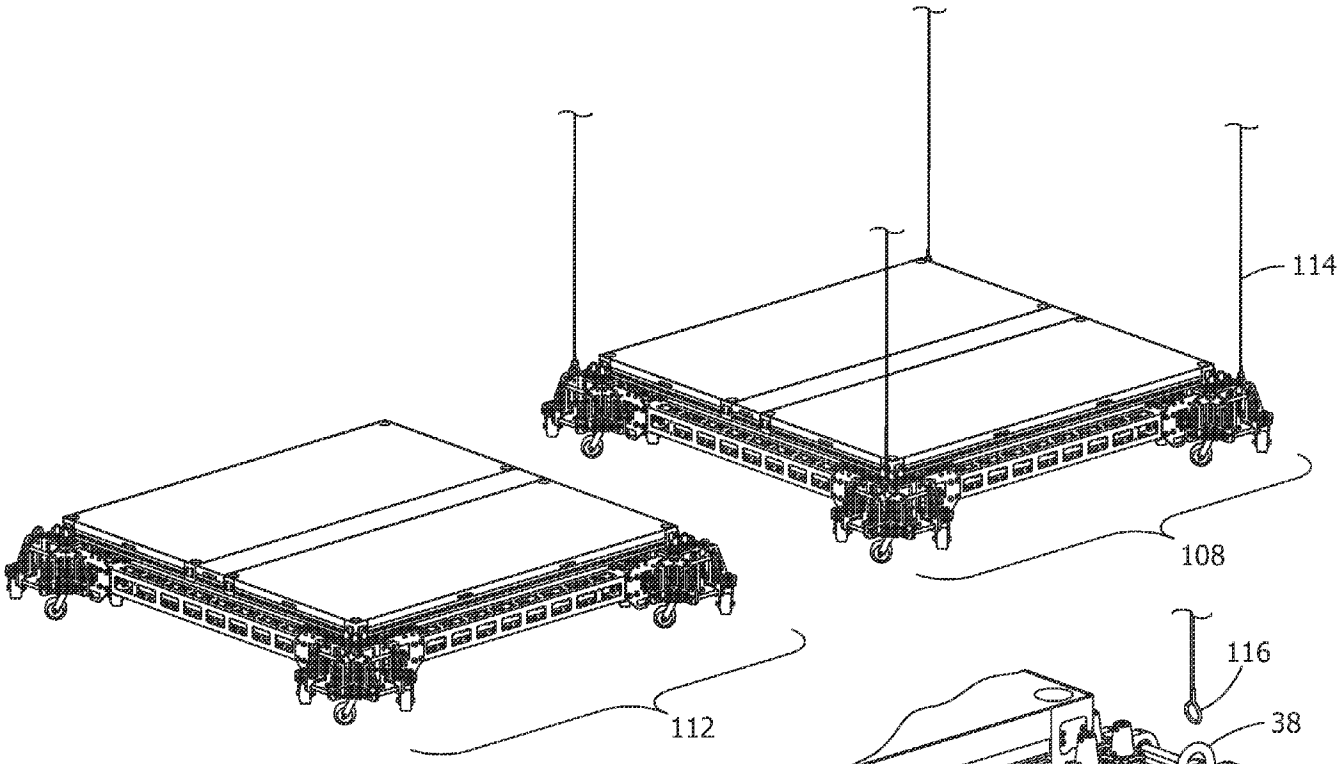
FIG. 20 illustrates an exemplary embodiment of an upper perspective view of adjacent tiers of a portable structure.
Figure 21:
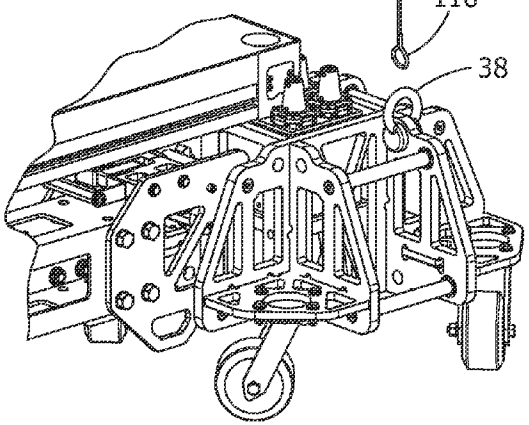
FIG. 21 illustrates an enlarged partial view taken from FIG. 20 of a portable structure.

As shown in FIG. 20, a second tier 112 is assembled in addition to first tier 108, and tiers 108, 112 positioned adjacent to each other. As further shown in FIGS. 20 and 21, sets of cables 114 each having a suitable fitting 116 are secured to corresponding lugs 38 that are connected to junction device 16. Cables 114 extend to lifting devices such as winches (not shown) for raising second tier 112. The number of cables 114 utilized to raise a tier may typically be sufficient to provide lifting at each junction device positioned at a corner of the tier, such as four, but additional lifting cables 114 may be utilized for attaching to additional junction devices used to construct the tier.

Figure 22:
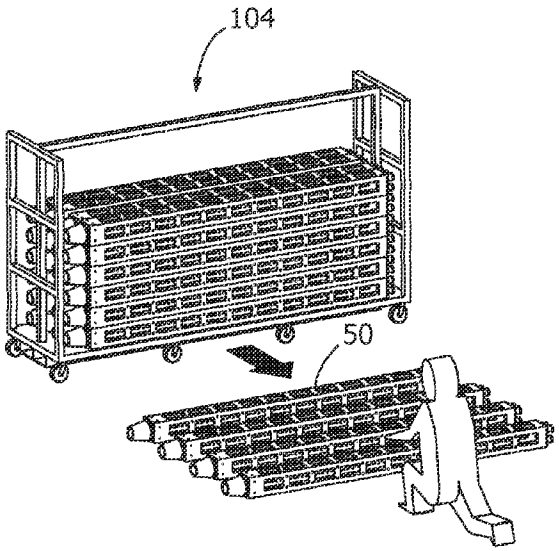
FIG. 22 illustrates an exemplary embodiment of an upper perspective view of a plurality of components provided for assembly of a portable structure.

As shown collectively in FIGS. 22 and 23, a plurality of beams 50 are removed from cart 104, corresponding to the number of supports required between raised first tier 108 relative to second tier 112. Once first tier 108 has been raised by cables 114 above second tier 112 and vertically aligned over second tier 112, a plurality of positioned beams 118 (of beams 50) are installed or positioned between tiers 112, 118. The plurality of positioned beams 118 are installed by directing first engagement features 52 of beams 50 into engagement with corresponding second engagement features 54 of junction devices 16 of second tier 112. In one embodiment, the extent of engagement between first engagement features 52 of beams 50 of the plurality of positioned beams 118 with corresponding second engagement features 54 of junction devices 16 is sufficient such that the beams are maintained in a substantially vertical orientation, i.e., not requiring supplemental lateral support, such that first tier 108 may be lowered into engagement with the plurality of positioned beams 118. That is, first engagement features 57 of beams 50 of the plurality of positioned beams 118 are brought into engagement with second engagement features of corresponding junction devices 16 of first tier 108.

It is to be understood that the order of a number of steps may be performed in a different order than that described. For example, the plurality of positioned beams 118 may be installed in second tier 112 prior to raising first tier 108.

Figure 25:
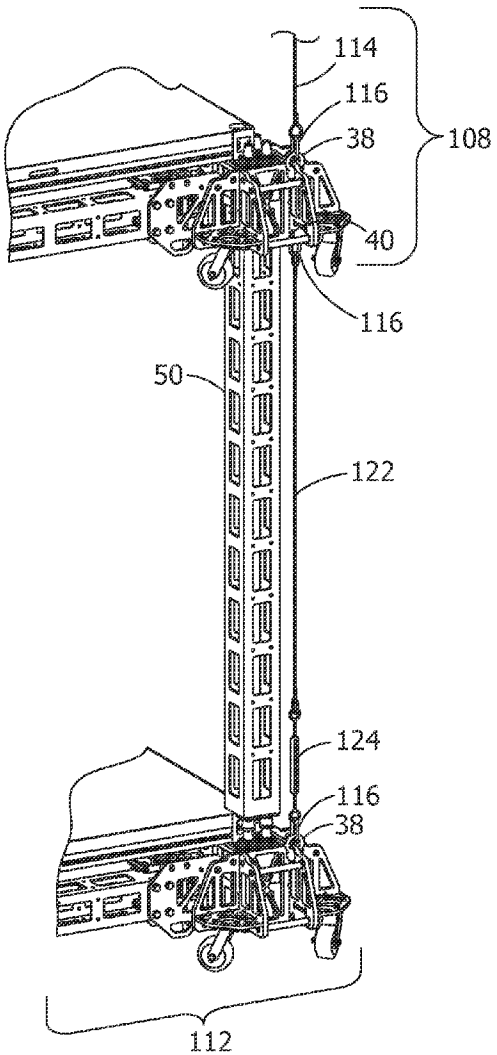
FIG. 25 illustrates a partial enlarged view taken from FIG. 24 of a multiple tier assembly of a portable structure.
Figure 24:
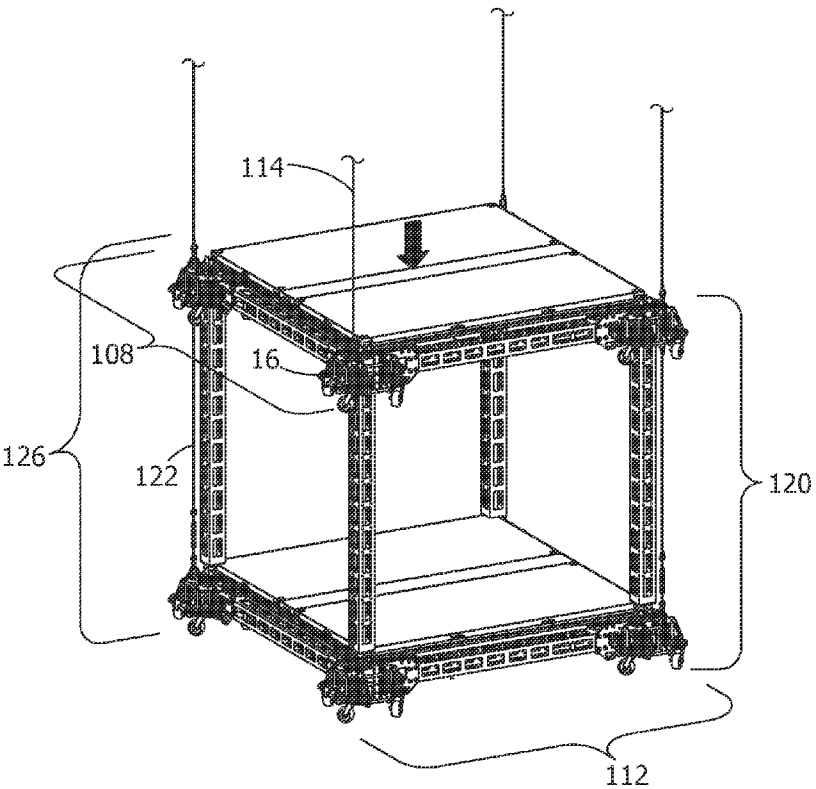

Upon first tier 108 being lowered into engagement with the plurality of positioned beams 118 (FIG. 23), as shown in FIGS. 24 and 25, the plurality of positioned beams 118 being re-identified as a plurality of engaged beams 120, the resulting compilation of first tier 108, second tier 112 and plurality of engaged beams 120 is re-identified as a multiple tier assembly 126. As further shown in FIG. 25, multiple tier assembly 126 includes a set of adjustable cables 122, with each adjustable cable 122 including appropriate fittings 116 secured at opposite ends of adjustable cable 122, and further including an adjustment device 124 such as a turnbuckle to provide length adjustment to adjustable cable 122. As further shown in FIG. 25, adjustable cables 122 are secured to corresponding junction devices 16, such as between a lug 38 of one junction device 16 and an aperture 40 formed in the other vertically positioned junction device 16. Typically, an adjustable cable 122 would be provided to correspond to each lifting cable 114. Adjustable cables 122 ensures multiple tier assembly 126 remains intact, i.e., tiers and interconnecting beams do not inadvertently become disengaged, and additionally permitting multiple tier assembly 126 to be collectively raised by lifting cables 114, for reasons including additional assembly or for collectively moving multiple tier assembly 126 to a different location, if desired.

It is to be understood that the term cable, such as relating to cable 114 and/or cable 122, is not merely limited to load carrying capabilities, but may also include electronic signal carrying capabilities and other capabilities as disclosed in Applicant's U.S. patent application Ser. No. 13/476,469 titled SUSPENDED FLYING RIG SYSTEM, which is incorporated by reference in its entirety.

Figure 26:
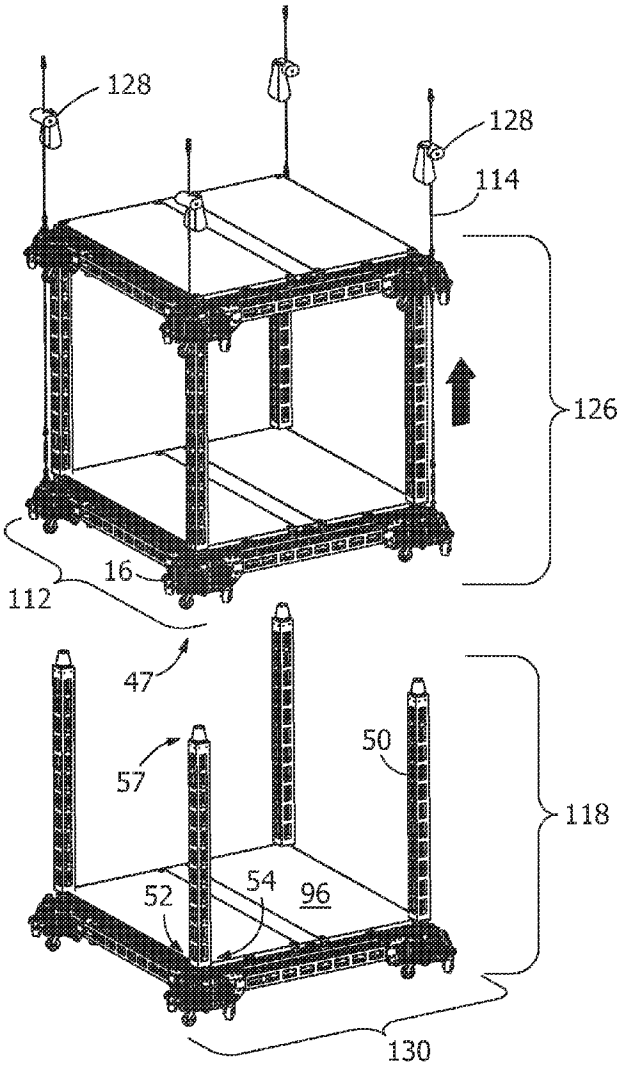
FIGS. 26 and 27 illustrate an exemplary embodiment of an upper perspective view during assembly of a tier with a multiple tier assembly of FIG. 24 of a portable structure.

Upon completion of construction of multiple tier assembly 126, as shown in FIG. 26, multiple tier assembly 126 is raised above and positioned over a third tier 130 such as by winches 128 selectably deploying lifting cables 114. Once multiple tier assembly 126 has been raised by cables 114 above third tier 130 and vertically aligned over third tier 130, a plurality of positioned beams 118 (of beams 50) are installed or positioned between third tier 130 and second tier 112 of multiple tier assembly 126. The plurality of positioned beams 118 are installed by directing first engagement features 52 of beams 50 into engagement with corresponding second engagement features 54 of junction devices 16.

Figure 28:
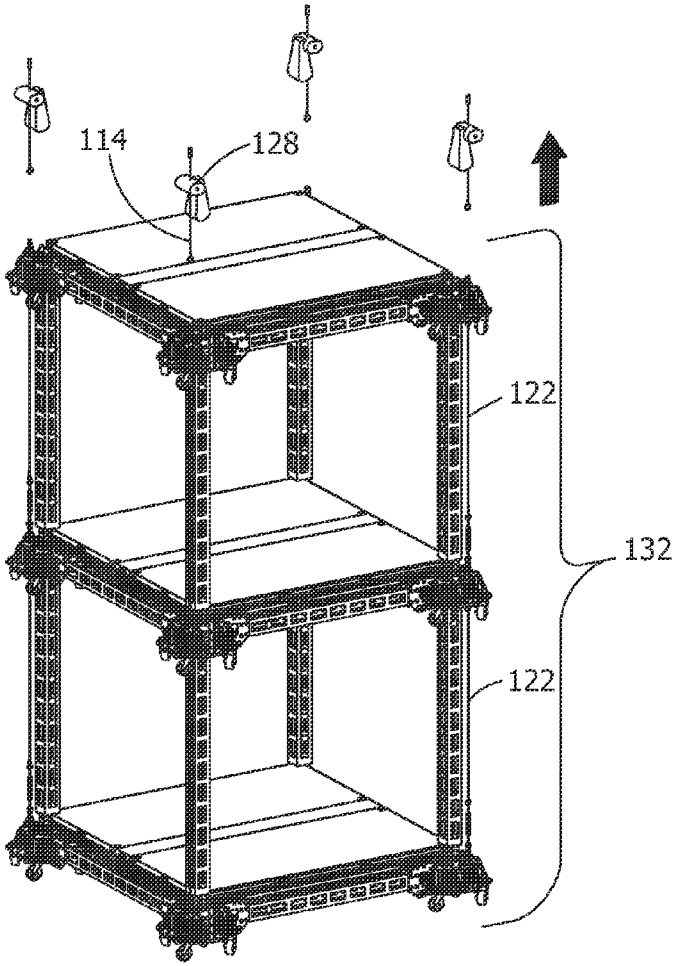
FIG. 28 illustrates an exemplary embodiment of an assembled multiple tier assembly taken from FIG. 27 of a portable structure.
Figure 27:
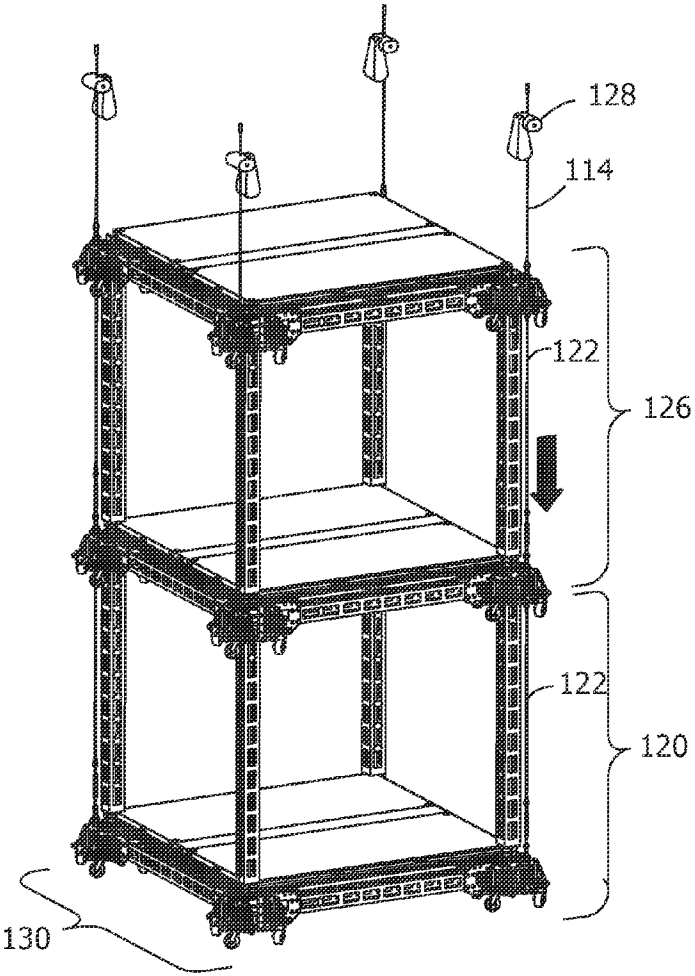

Upon second tier 112 of multiple tier assembly 126 being lowered into engagement with the plurality of positioned beams 118 (FIG. 26), as shown in FIGS. 27 and 28, the plurality of positioned beams 118 being re-identified as a plurality of engaged beams 120, the resulting compilation of multiple tier assembly 126, third tier 130 and plurality of engaged beams 120 is re-identified as a multiple tier assembly 132. As further shown in FIG. 28, multiple tier assembly 132 includes a set of adjustable cables 122 as previously discussed.

It is to be understood that disassembly of multiple tier assembly 132 may be achieved by a reversal of the steps previously discussed and utilized to assemble multiple tier assembly 132.

Figure 29:
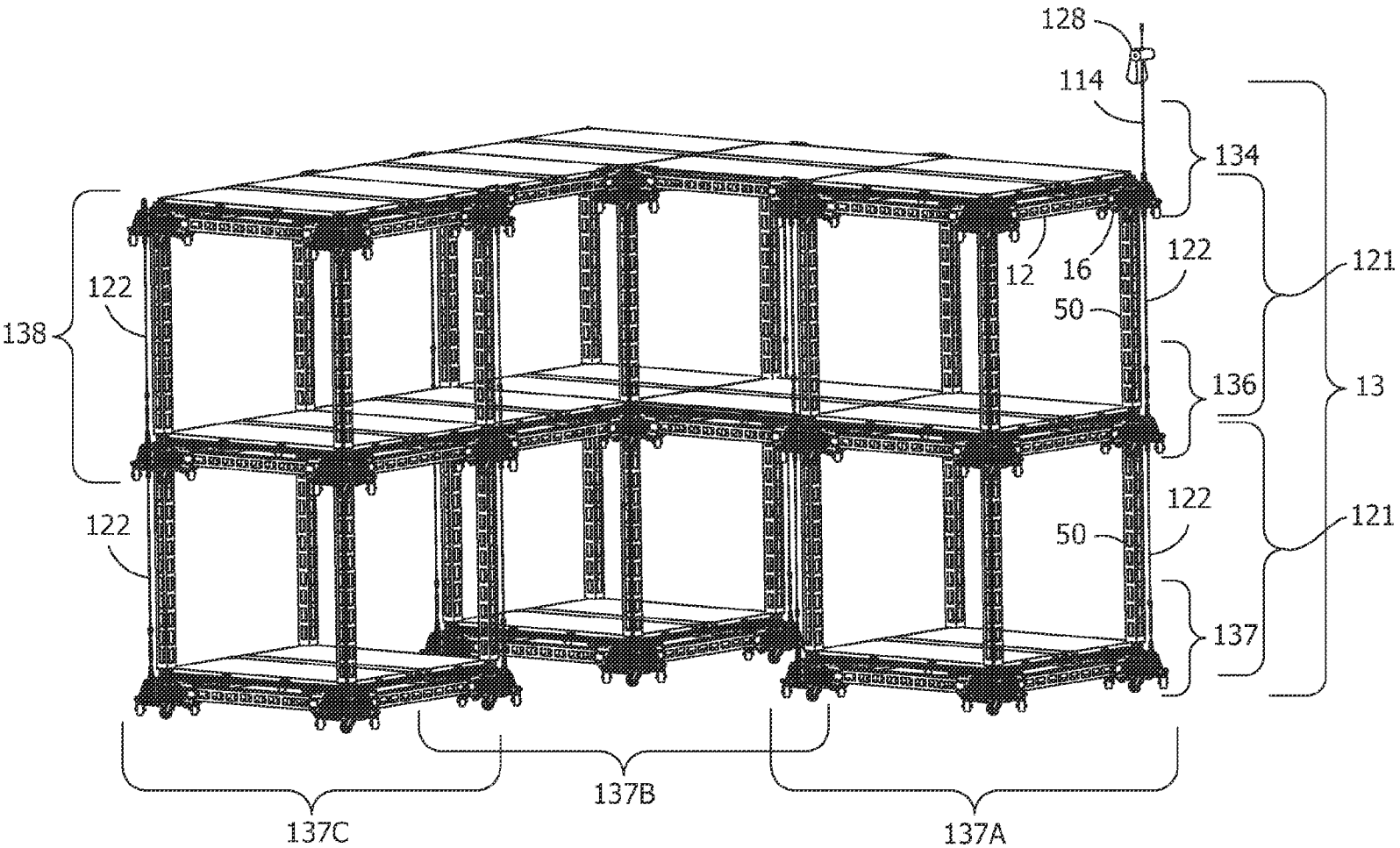
FIG. 29 illustrates an exemplary embodiment of a multiple tier assembly of a portable structure.

As shown in FIG. 29, steps previously discussed above will be employed for assembling a multiple tier assembly 139. That is, a plurality of beams 12, beams 50, junction devices 16 and decking 96 is provided and assembled together in a manner as previously discussed to produce a first tier 134. In a similar manner, a second tier 136 is assembled. Once first and second tiers 134, 136 are assembled, first tier 134 is raised and positioned vertically (by a sufficient number of lifting cables 114 and winches 128) over second tier 136. A plurality of positioned and engaged beams 121 (beams 50) are inserted between and subsequently engaged with corresponding engagement features of first tier 134 and second tier 136 and secured with adjustable cables 122, forming a multiple tier assembly 138. A third tier 137 that includes three separate, smaller tiers 137A, 137B, and 137C is then assembled.

As further shown in FIG. 29, once third tier 137 is assembled, multiple tier assembly 138 is raised and positioned vertically (by a sufficient number of lifting cables 114 and winches 128) over third tier 137. A plurality of positioned and engaged beams 121 (beams 50) are inserted between and subsequently engaged with corresponding engagement features of third tier 137 and second tier 136 and secured with adjustable cables 122, forming multiple tier assembly 139.

Figure 30:
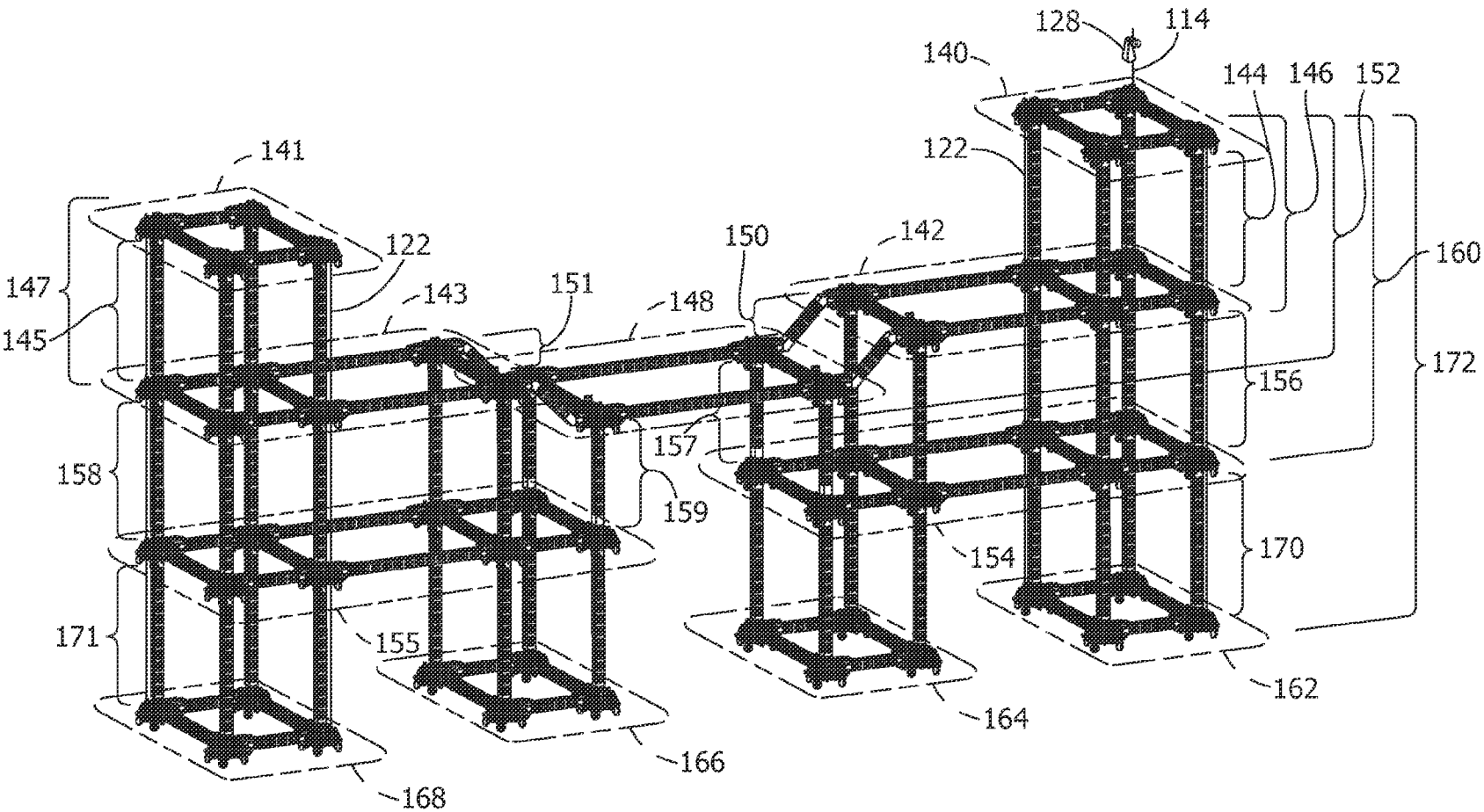
FIG. 30 illustrates an exemplary embodiment of a multiple tier assembly of a portable structure.

As shown in FIG. 30, steps previously discussed above will be employed for assembling a more involved multiple tier assembly 172. For sake of more easily understanding the disclosure, decking 96 has been removed and will not be further discussed. As previously discussed, a plurality of beams 12, beams 50 and junction devices 16 is provided and assembled together in a manner as previously discussed to produce first tiers 140, 141. In a similar manner, second tiers 142, 143 are assembled. Once first and second tiers 140, 141, 142, 143 are assembled, first tiers 140, 141 are raised and positioned vertically (by a sufficient number of lifting cables 114 and winches 128) over corresponding second tiers 142, 143. A plurality of positioned and engaged beams 144 (beams 50) are inserted between and subsequently engaged with corresponding engagement features of first tier 140 and second tier 142 and secured with adjustable cables 122, forming a multiple tier assembly 146. A plurality of positioned and engaged beams 145 (beams 50) are inserted between and subsequently engaged with corresponding engagement features of first tier 141 and second tier 143 and secured with adjustable cables 122, forming a multiple tier assembly 147. A third tier 148 is assembled.

As further shown in FIG. 30, once third tier 148 is assembled, multiple tier assembly 146 is raised and positioned vertically (by a sufficient number of lifting cables 114 and winches 128) over one end of third tier 148. Similarly, multiple tier assembly 147 is raised and positioned vertically (by a sufficient number of lifting cables 114 and winches 128) over the opposed end of third tier 148. A plurality of positioned and engaged beams 150 (beams 50) are inserted between and subsequently engaged with corresponding engagement features of one end of third tier 148 and multiple tier assembly 146 and secured with adjustable cables 122, forming a portion of multiple tier assembly 152. A plurality of positioned and engaged beams 151 (beams 50) are inserted between and subsequently engaged with corresponding engagement features of the opposite end of third tier 148 and multiple tier assembly 147 and secured with adjustable cables 122, forming the remaining portion of multiple tier assembly 152. Fourth tiers 154, 155 are assembled.

As further shown in FIG. 30, once fourth tiers 154, 155 are assembled, multiple tier assembly 152 is raised and positioned vertically (by a sufficient number of lifting cables 114 and winches 128) over each of fourth tier 154 and fourth tier 155. A plurality of positioned and engaged beams 156 (beams 50) are inserted between and subsequently engaged with corresponding engagement features of one portion of fourth tier 154 and second tier 142 of multiple tier assembly 152 and secured with adjustable cables 122. A plurality of positioned and engaged beams 157 (beams 50) are inserted between and subsequently engaged with corresponding engagement features of the remaining portion of fourth tier 154 and one end of third tier 148 of multiple tier assembly 152 and secured with adjustable cables 122, collectively forming a portion of multiple tier assembly 160.

As further shown in FIG. 30, a plurality of positioned and engaged beams 158 (beams 50) are inserted between and subsequently engaged with corresponding engagement features of a portion of fourth tier 155 and second tier 143 of multiple tier assembly 147 and secured with adjustable cables 122. A plurality of positioned and engaged beams 159 (beams 50) are inserted between and subsequently engaged with corresponding engagement features of the remaining portion of fourth tier 155 and the opposite end of third tier 148 of multiple tier assembly 152 and secured with adjustable cables 122, collectively forming the remaining portion of multiple tier assembly 160. Fifth tiers 162, 164, 166, 168 are assembled.

As further shown in FIG. 30, once fifth tiers 162, 164, 166, 168 are assembled, multiple tier assembly 160 is raised and positioned vertically (by a sufficient number of lifting cables 114 and winches 128) over each of fifth tier 162, fifth tier 164, fifth tier 166, and fifth tier 168. A plurality of positioned and engaged beams 170 (beams 50) are inserted between and subsequently engaged with corresponding engagement features of each of fifth tier 162 and fifth tier 164, and fourth tier 154 of multiple tier assembly 160 and secured with adjustable cables 122, forming a portion of multiple tier assembly 172. A plurality of positioned and engaged beams 171 (beams 50) are inserted between and subsequently engaged with corresponding engagement features of each of fifth tier 166 and fifth tier 168, and fourth tier 155 of multiple tier assembly 160 and secured with adjustable cables 122, forming the remaining portion of multiple tier assembly 172.

It is to be understood that disassembly of multiple tier assembly 172 may be achieved by a reversal of the steps previously discussed and utilized to assemble multiple tier assembly 172.

In summary, a platform structure or multiple tier assembly is provided by assembly of the uppermost tier(s), assembling the next-to-uppermost tier(s), raising and positioning the uppermost tier(s) over the next-to-uppermost tier(s), inserting and engaging beams between the uppermost tier(s) and the next-to-uppermost tier(s) (engagement of the beams achieved by lowering the uppermost tier(s) onto the inserted beams extending upwardly from the next-to-uppermost tier(s)), and securing adjustable cables between the uppermost tier(s) and the next-to-uppermost tier(s) to form an uppermost multiple tier assembly. The steps are then repeated for adding tiers to the uppermost multiple tier assembly, and the order of steps reversed to disassemble the uppermost multiple tier assembly.

By implying the assembly/disassembly steps of the disclosure, laborers of a portable structure do all of their assembly/disassembly work on the ground. That is, since even a multiple tier assembly is assembled from "top-down" and alternately disassembled from "bottom up", the laborers are not required to climb onto tiers that are suspended or supported by another tier, thereby significantly enhancing safety associated with such tasks.

It is to be understood that the term tiers refers generally to tiers that are at the same elevation, assuming the beams used to set the vertical height of the tiers are of the same length. Otherwise, tiers can normally be distinguished from each other (or combined or otherwise grouped with each other) by the number of levels of vertically oriented beams used to support the tier, such as identified in FIG. 30, although other arrangements or constructions may be used.

While the disclosure has been described with reference to a preferred embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A portable structure comprising a plurality of beams having a first engagement feature; and a plurality of junction devices having a second engagement feature;

the first engagement features and corresponding second engagement features being rigidly engagable, the rigidly engaged engagement features defining a multi-point connection therebetween;

wherein each multi-point connection includes at least two sets of an individual engagement portion of the first engagement feature of the beam engaging a corresponding individual engagement portion of a corresponding second engagement feature of the junction device;

wherein the engagement features being manually actuatable and self-contained;

wherein articulating linkage being actuatable to achieve rigid engagement between the first engagement feature and the corresponding second engagement feature.

2. The structure of claim 1, wherein when engaged with one another, at least a portion of at least one of the engagement features between a beam of the plurality of beams and a corresponding junction device of the plurality of junction devices is actuatable between an engaged position and a disengaged position.

3. The structure of claim 2, wherein the portion of the at least one of the engagement features achieves a fail-safe engagement when in the engaged position.

4. The structure of claim 1, wherein the junction devices have interlocking frame members.

5. The structure of claim 4, wherein the interlocking frame members are substantially orthogonally positioned.

6. The structure of claim 5, wherein the interlocking frame members define a tick-tack-toe profile.

7. The structure of claim 4, wherein at least two interlocking frame members are substantially identical.

8. The structure of claim 1, wherein one of the engagement features includes a pair of pins.

9. The structure of claim 8, wherein the pins of the pair of pins are parallel to each other.

10. The structure of claim 8, wherein the pins of the pair of pins are offset from each other relative to a facing wall of the junction device.

11. The structure of claim 1, wherein the beams extend substantially orthogonally relative to one another.

12. The structure of claim 1, wherein the junction devices have a third engagement feature for engaging substantially vertically oriented beams.

13. The structure of claim 12, wherein the third engagement feature is configured to secure decking thereto.

14. A method for providing a portable structure, comprising providing a plurality of beams having a first engagement feature;

providing a plurality of junction devices having a second engagement feature, the first engagement features and corresponding second engagement features being rigidly engagable and self-contained;

directing a first engagement feature of a beam of the plurality of beams and a corresponding second engagement feature of a junction device of the plurality of junction devices into engagement therebetween; and manually rigidly engaging the corresponding first and second engagement features to form multi-point connections therebetween, wherein each multi-point connection includes at least two sets of an individual engagement portion of the first engagement feature of the beam engaging a corresponding individual engagement portion of a corresponding second engagement feature of the junction device, wherein articulating linkage being actuatable to achieve rigid engagement between the first engagement feature and the corresponding second engagement feature.

15. The method of claim 14, comprising repeatedly directing corresponding first and second engagement features into engagement and manually rigidly engaging the corresponding first and second engagement features of respective beams and junction devices to form a first tier;

repeatedly directing corresponding first and second engagement features into engagement and manually rigidly engaging the corresponding first and second engagement features of respective beams and junction devices to form a second tier;

raising the first tier above the second tier;

positioning a plurality of beams between the first tier and the second tier, engagement features of the plurality of beams and corresponding junction devices of the second tier being engaged; and lowering the first tier, the engagement features of beams of the plurality of beams positioned between the first tier and the second tier and further positioned opposite the second tier being engaged with corresponding engagement features of junction devices of the first tier.

16. The method of claim 15, comprising providing a plurality of decking for securing to the tiers.

17. The method of claim 15, comprising securing adjustable cables to junction devices that are substantially vertically positioned relative to each other, the collective first tier and second tier defining a multiple tier assembly.

18. The method of claim 17, comprising repeatedly directing corresponding first and second engagement features into engagement and manually rigidly engaging the corresponding first and second engagement features of respective beams and junction devices to form a third tier;

raising the multiple tier assembly above the third tier;

positioning a plurality of beams between the third tier and the second tier of the multiple tier assembly, engagement features of the plurality of beams and corresponding junction devices of the third tier being engaged; and lowering the multiple tier assembly, the engagement features of beams of the plurality of beams positioned between the third tier and the second tier of the multiple tier assembly and further positioned opposite the third tier being engaged with corresponding engagement features of junction devices of the second tier of the multiple tier assembly.

19. The method of claim 18, further comprising raising the first tier and the second tier of the multiple tier assembly, the engagement features of beams of the plurality of beams positioned between the third tier and the second tier of the multiple tier assembly and further positioned opposite the third tier being disengaged from corresponding engagement features of junction devices of the second tier of the multiple tier assembly;

removing the plurality of beams positioned between the third tier and the second tier of the multiple tier assembly;

lowering the multiple tier assembly adjacent the third tier;

disassembling the third tier;

removing adjustable cables from the multiple tier assembly comprising the first tier, the second tier and the plurality of beams positioned between the first tier and the second tier of the multiple tier assembly;

raising the first tier, the engagement features of beams of the plurality of beams positioned between the second tier and the first tier and further positioned opposite the second tier of the multiple tier assembly being disengaged from corresponding engagement features of junction devices of the first tier;

removing the plurality of beams positioned between the first tier and the second tier of the multiple tier assembly;

lowering the first tier adjacent the second tier;

disassembling the first tier; and disassembling the second tier.

20. The method of claim 15, further comprising raising the first tier, the engagement features of beams of the plurality of beams positioned between the second tier and the first tier consists/and further positioned opposite the second tier of the multiple tier assembly being disengaged from corresponding engagement features of junction devices of the first tier;

removing the plurality of beams positioned between the first tier and the second tier of the multiple tier assembly;

lowering the first tier adjacent the second tier;

disassembling the first tier; and disassembling the second tier.

* * * * *